US011154125B2

(12) United States Patent
Mercier

(10) Patent No.: US 11,154,125 B2
(45) Date of Patent: Oct. 26, 2021

(54) HAIR-STYLING DEVICE

(71) Applicants: Michel Mercier, Herzlia (IL); M.R.T.R. MERCIER LTD., Tel Aviv (IL)

(72) Inventor: Michel Mercier, Herzlia (IL)

(73) Assignee: M.R.T.R. MERCIER LTD., Tel Aviv (IL)

( * ) Notice: Subject to any disclaimer, the term of this patent is extended or adjusted under 35 U.S.C. 154(b) by 779 days.

(21) Appl. No.: 15/434,709

(22) Filed: Feb. 16, 2017

(65) Prior Publication Data

US 2017/0238670 A1 Aug. 24, 2017

Related U.S. Application Data

(63) Continuation-in-part of application No. PCT/IB2015/056328, filed on Aug. 20, 2015.

(30) Foreign Application Priority Data

Aug. 21, 2014 (IL) ..... 234242
Aug. 21, 2014 (IL) ..... 234243

(51) Int. Cl.

| | |
|---|---|
| ***A45D 24/04*** | (2006.01) |
| ***A45D 2/00*** | (2006.01) |
| ***A46B 9/06*** | (2006.01) |
| ***A46D 1/00*** | (2006.01) |
| ***A46B 9/02*** | (2006.01) |
| ***A45D 24/10*** | (2006.01) |
| ***A46B 7/08*** | (2006.01) |
| ***A45D 20/48*** | (2006.01) |
| ***A45D 20/52*** | (2006.01) |

(52) U.S. Cl.

CPC ..... *A45D 2/002* (2013.01); *A45D 20/48* (2013.01); *A45D 20/525* (2013.01); *A45D 24/04* (2013.01); *A45D 24/10* (2013.01); *A46B 7/08* (2013.01); *A46B 9/023* (2013.01); *A46B 9/06* (2013.01); *A46D 1/0238* (2013.01); *A45D 2200/155* (2013.01); *A46B 2200/104* (2013.01); *A46B 2200/3086* (2013.01)

(58) Field of Classification Search

CPC ..... A45D 2/002; A45D 20/48; A45D 20/525; A45D 24/00; A45D 24/24; A46B 7/02; A46B 7/06; A46B 7/08; A46B 9/023; A46B 9/06; A46B 2200/104

USPC ..... 15/172, 201

See application file for complete search history.

(56) References Cited

U.S. PATENT DOCUMENTS

| | | | | |
|---|---|---|---|---|
| 2,763,895 A * | 9/1956 | Iesersek | A45D 24/04 | 264/138 |
| 3,133,546 A * | 5/1964 | Dent | A45D 24/16 | 132/120 |
| 2008/0099031 A1* | 5/2008 | Walters | A45D 24/22 | 132/120 |
| 2009/0083917 A1* | 4/2009 | Taggart | A45D 24/16 | 15/22.1 |

* cited by examiner

*Primary Examiner* — Rachel R Steitz

(74) *Attorney, Agent, or Firm* — The Roy Gross Law Firm, LLC; Roy Gross

(57) ABSTRACT

Disclosed are hair-styling devices.

16 Claims, 23 Drawing Sheets

HAIR-STYLING DEVICE

RELATED APPLICATIONS

The present application is a Continuation-In-Part of PCT Patent Application IB2015/056328 published on Feb. 25, 2016 as WO 2016/027251 and gains priority from Israel Patent Applications IL234242 and IL234243 both filed 21 Aug. 2014, all which are included by reference as if fully set forth herein.

FIELD AND BACKGROUND OF THE INVENTION

The invention, in some embodiments, relates to the field of grooming, and more specifically, to hair-styling devices.

Many people prefer growing long hair. If not cared for properly, the long hair of a person looks unkempt and ratty, giving the person an unappealing appearance.

An important aspect of caring for long hair is combing: passing a comb having rigid teeth through the hair. Combing spreads natural nourishing oils from the scalp along the length of the hair and removes dirt and other unwanted materials while aligning and separating the hair strands one from the other, giving an appealing appearance and shine to the hair. In some instances during combing, hair becomes tangled. A tangle can be loosened by repeated judicious and careful combing, but this is practically difficult. Instead, combing a tangle often leads to pain and tearing of the hair. It would be advantageous to have a hair styling device that allows combing of hair with less pain, less tearing of hair and improved ability to loosen tangles.

Some hair is straight and some hair is curly or wavy. Often, people with curly or wavy hair want to straighten their hair. Professional hair straightening using heat or chemical treatment is expensive and requires a substantial investment of time. Personal hair straightening devices for home-use are known, which use typically involves sequentially passing manually-straightened locks of hair between two heating elements. Straightening hair with such devices is time consuming, challenging to do properly without damaging the hair, and often leads to burns on the side of the head. It would be advantageous to have a simple-to-use hair styling device that allows straightening of hair with little danger of burns.

SUMMARY OF THE INVENTION

Some embodiments of the invention relate to devices useful for styling hair.

According to an aspect of some embodiments of the invention, there is provided a device suitable for use in the styling of hair, the device comprising:

a) a device body;

b) physically associated with the device body, a styling surface having at least one peripheral edge; and c) a plurality of at least ten combing teeth distributed on the styling surface, each such combing tooth fixedly attached to the styling surface through a respective tooth base so as to protrude perpendicularly from the styling surface, each such combing tooth having:

i. along a height axis perpendicular to the styling surface, a height measured from the base of the tooth at the styling surface to a respective tooth tip, ii. along a length axis of the tooth on the styling surface, a length, iii. along a width axis on the styling surface and perpendicular to the length axis, a width, the width being less than the length, iv. a top cross section in a plane including the width axis and the length axis, v. a front cross section in a plane including the width axis and the height axis, and vi. a side cross section in a plane including the length axis and the height axis;

wherein the length axes of the combing teeth of the plurality of teeth are parallel and define a combing direction of the styling surface.

According to an aspect of some embodiments of the invention, there is also provided a device suitable for use in the styling of hair, comprising: a) a device body; and b) physically associated with the device body, a backing component bearing a styling surface;

wherein the backing component is movably fixed to the device body, allowing rotation of the styling surface relative to the device body around a rotation axis perpendicular to the styling surface.

According to an aspect of some embodiments of the invention, there is also provided a device suitable for use in the styling of hair, comprising: a) a device body; and b) at least ten teeth suitable for combing hairs, and further comprising inorganic particles physically associated with an outer surface of the teeth, so that the combing teeth are thereby configured for polishing hair.

According to an aspect of some embodiments of the invention, there is also provided a device suitable for use in the styling of hair, the device comprising:

a) a device body;

b) physically associated with the device body, a styling surface having at least one peripheral edge;

c) a plurality of combing teeth distributed on the styling surface, each the combing tooth fixedly attached to the styling surface;

wherein the device is configured to allow heating of the combing teeth thereby allowing use of the device for thermally induced straightening of hair;

wherein the combing teeth are made of a heat-conducting material;

further comprising guide teeth made of a heat-insulating material having a thermal conductivity of not more than 2 W/(m K), the guide teeth having a height and attached to the device so as to protrude beyond the tips of the combing teeth, wherein the guide teeth are located along a periphery of the styling surface;

further comprising a rigid scalp guard attached to the device so as to be located above the styling surface, the scalp guard and guide teeth configured to prevent physical contact of a scalp with heated combing teeth during use of the device; and the scalp guard comprising one or more bars oriented in parallel to the combing direction.

Unless otherwise defined, all technical and scientific terms used herein have the same meaning as commonly understood by one of ordinary skill in the art to which the invention pertains. In case of conflict, the specification, including definitions, will take precedence.

Specifically, as used herein the term "tooth" and grammatical variants thereof refer to a component analogous to the component known in the art of hair styling (i.e., tooth or teeth of a comb) and do not include physical features inherent in other meanings of the word.

As used herein, the terms "comprising", "including", "having" and grammatical variants thereof are to be taken as specifying the stated features, integers, steps or components but do not preclude the addition of one or more additional features, integers, steps, components or groups thereof. These terms encompass the terms "consisting of" and "consisting essentially of".

As used herein, the indefinite articles "a" and "an" mean "at least one" or "one or more" unless the context clearly dictates otherwise.

As used herein, when a numerical value is preceded by the term "about", the term "about" is intended to indicate +/−10%.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures:

FIG. 1A in isometric view from the front; FIG. 1B in end view from the handle, FIG. 1C in front view; FIG. 1D a combing tooth in isometric view; FIG. 1D' a variant combing tooth in isometric view; FIG. 1E a combing tooth in side view; FIG. 1F a combing tooth in top view; FIG. 1G a combing tooth in front view; FIG. 1H a backing component; FIG. 1I a body component; and FIG. 1J connection of backing component with body component in side cross section;

FIG. 2A in isometric view from the front; FIG. 2B is an exploded view, FIG. 2C in front view; FIG. 2D a combing tooth in isometric view; FIG. 2E a combing tooth in side view; FIG. 2F a combing tooth in top view; and FIG. 2G a combing tooth in front view;

FIG. 11A the combing tooth in isometric view; FIG. 11B in side view; FIG. 11C in top view; and FIG. 11D in front view.

DESCRIPTION OF SOME EMBODIMENTS OF THE INVENTION

Figure 1A:
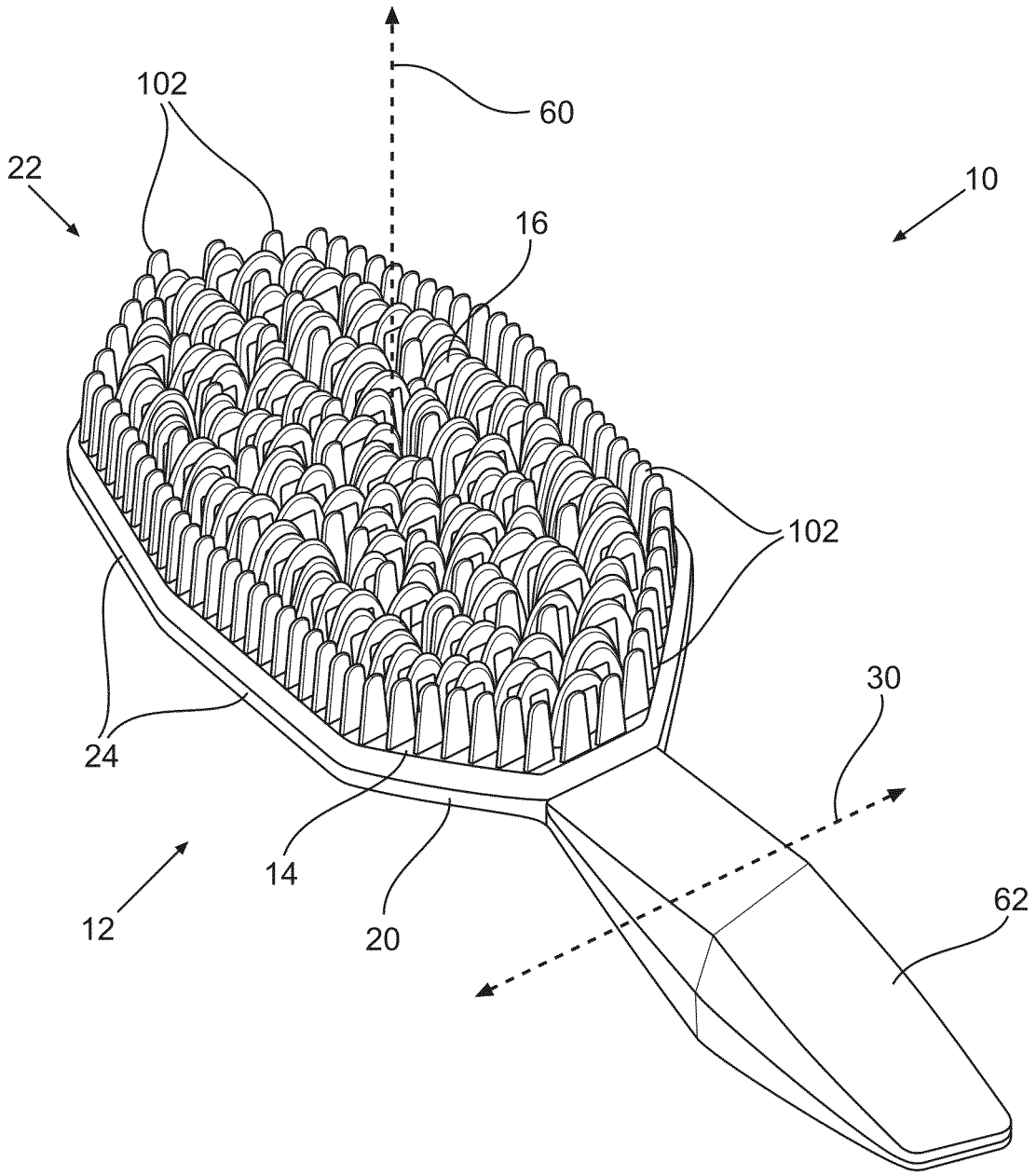
FIGS. 1A to 1J schematically depict an embodiment of a device according to the teachings herein suitable for combing hair.

Some embodiments of the invention relate to hair-styling devices.

The principles, uses and implementations of the teachings of the invention may be better understood with reference to the accompanying description and figures. Upon perusal of the description and figures present herein, one skilled in the art is able to implement the teachings of the invention without undue effort or experimentation. In the Figures, like reference numerals refer to like parts.

Before explaining at least one embodiment in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

As discussed in the background above, there are challenges in combing hair, especially long hair, specifically how to comb hair to loosen tangles without causing pain and/or tearing the hair. As also discussed in the background above, there are challenges in straightening hair, specifically how to straighten hair in a non-professional setting in a simple and safe manner.

Some embodiments of the devices according to teachings herein at least partially meet either one or both of the challenges, thereby providing devices that may allow easy combing that is effective in releasing tangles while avoiding tearing the hair and/or allow effective hair straightening using a simple combing motion.

Thus, according to an aspect of some embodiments of the teachings herein, there is provided a device suitable for use in the styling of hair, especially human hair, the device comprising:

a) a device body;

b) physically associated with the device body, a styling surface having at least one peripheral edge; and c) a plurality of at least ten combing teeth distributed on the styling surface, each such combing tooth fixedly attached to the styling surface through a respective tooth base so as to protrude perpendicularly from the styling surface, each such combing tooth having:

i. along a height axis perpendicular to the styling surface, a height measured from the base of the tooth at the styling surface to a respective tooth tip, ii. along a length axis of the tooth on the styling surface, a length, iii. along a width axis on the styling surface and perpendicular to the length axis, a width, the width being less than the length, iv. a top cross section in a plane including the width axis and the length axis, v. a front cross section in a plane including the width axis and the height axis, and vi. a side cross section in a plane including the length axis and the height axis;

wherein the length axes of the combing teeth of the plurality of teeth are parallel and define a combing direction of the styling surface. In some embodiments the plurality is of at least 20, at least 30 and even at least 40 such combing teeth.

Figure 1B:
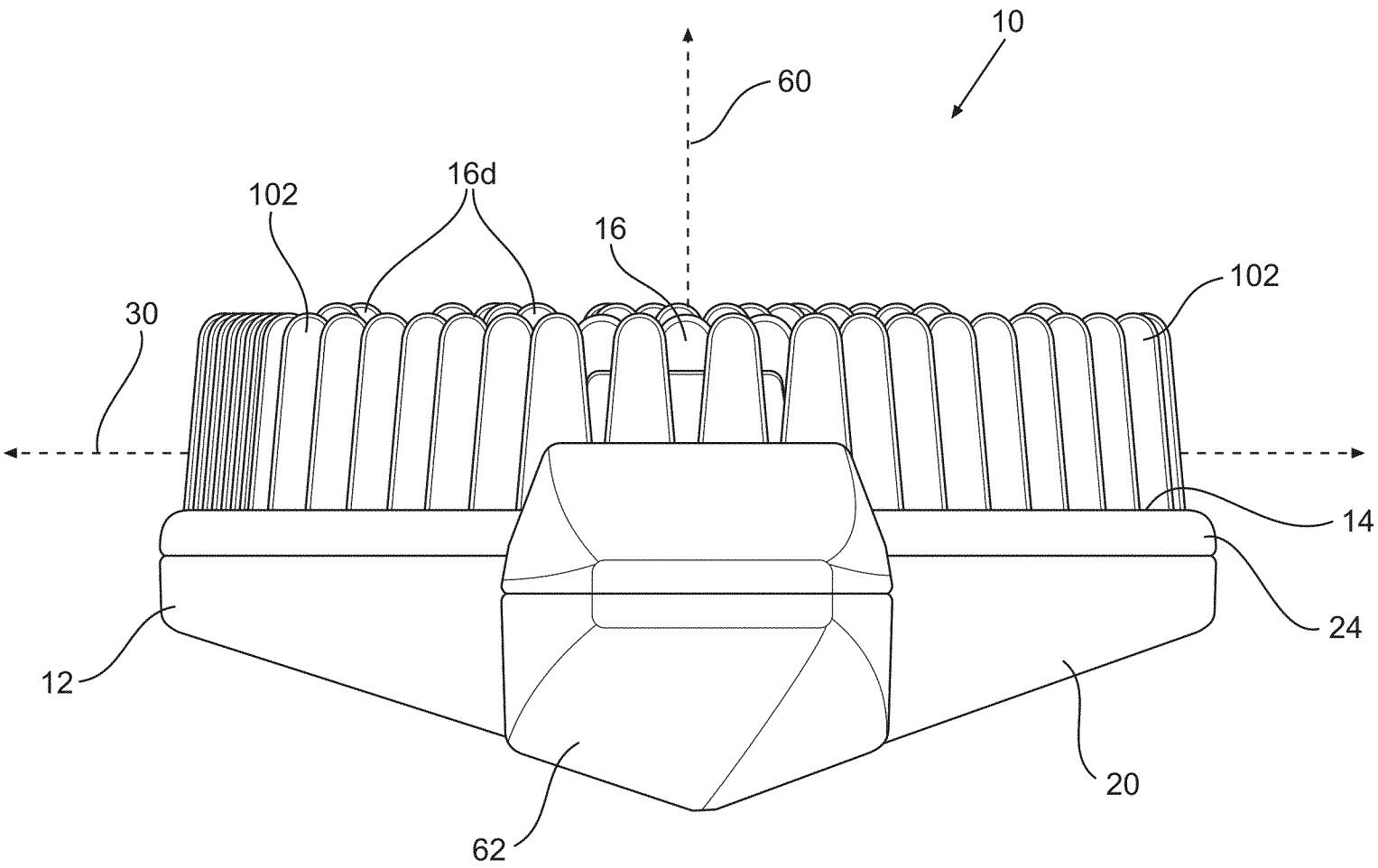
Figure 1C:
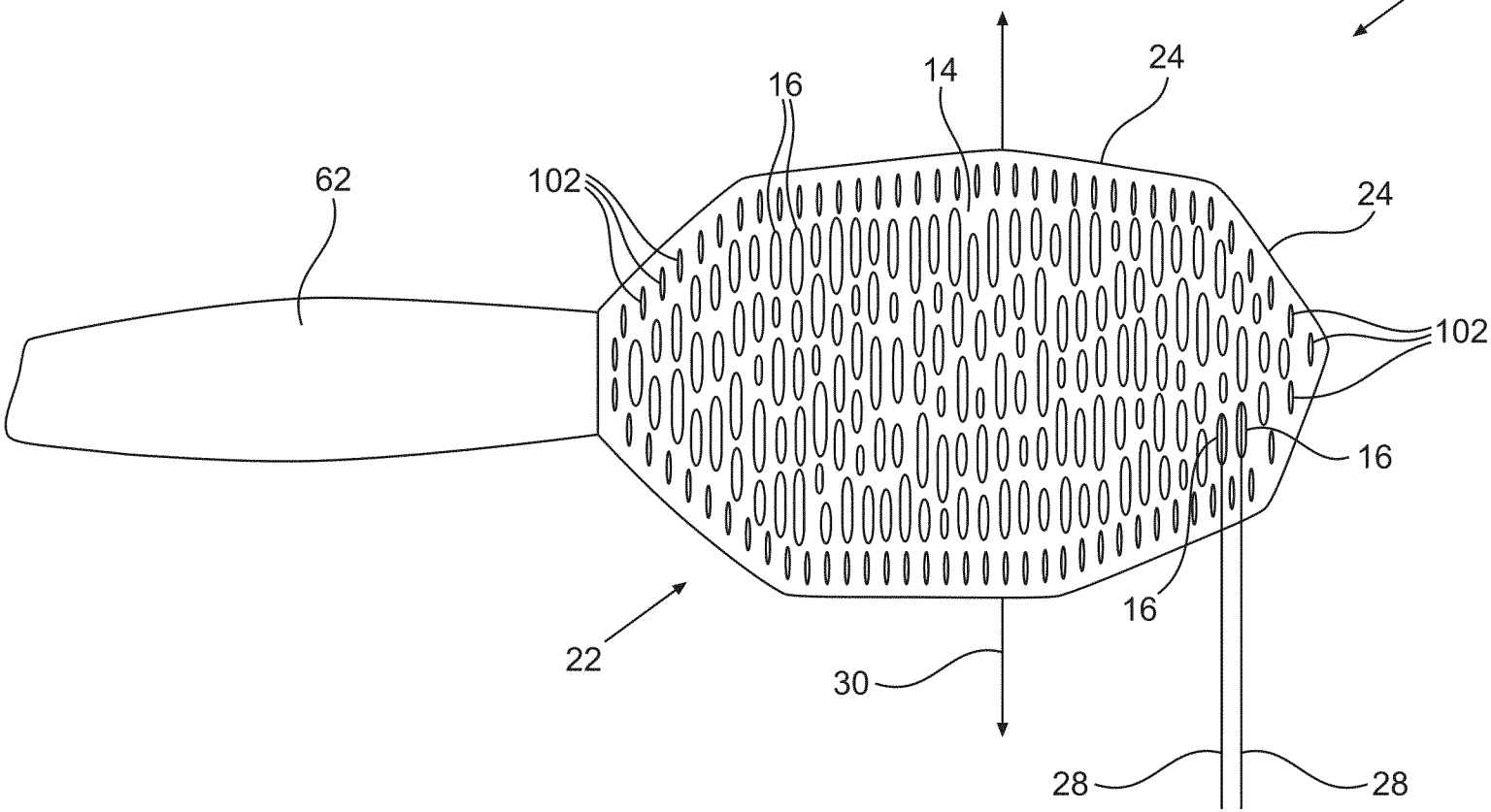
Figure 1D:
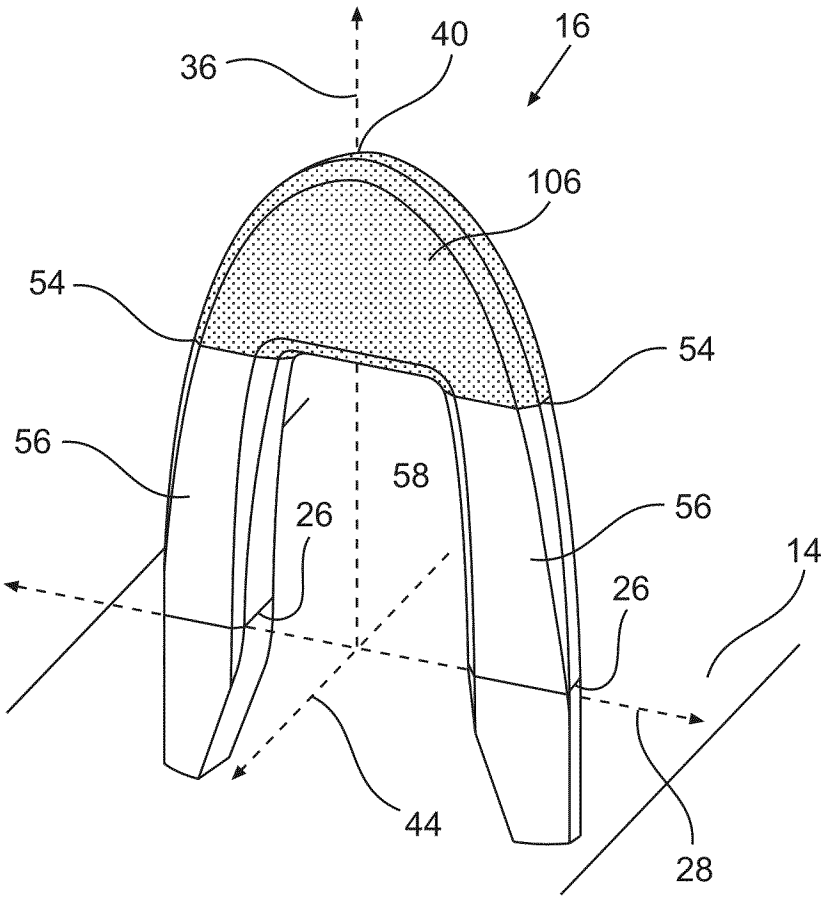
Figure 1D:
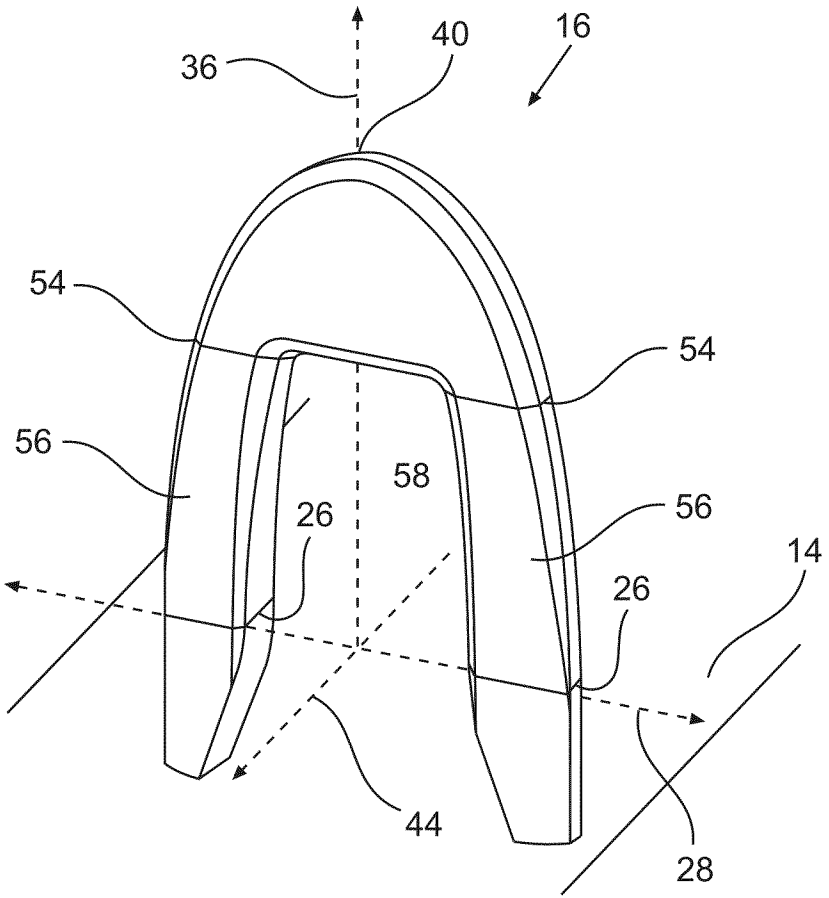
Figure 1E:
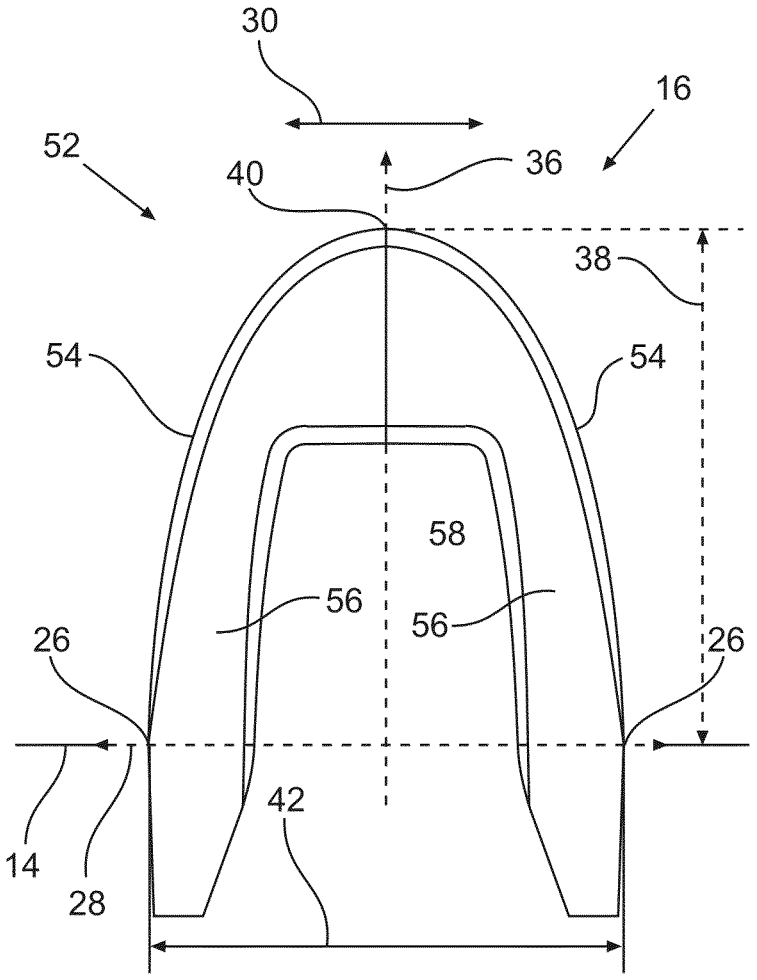
Figure 1G:
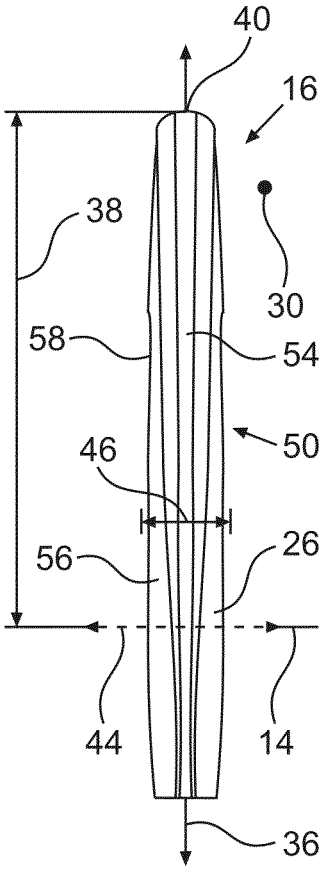
Figure 1F:
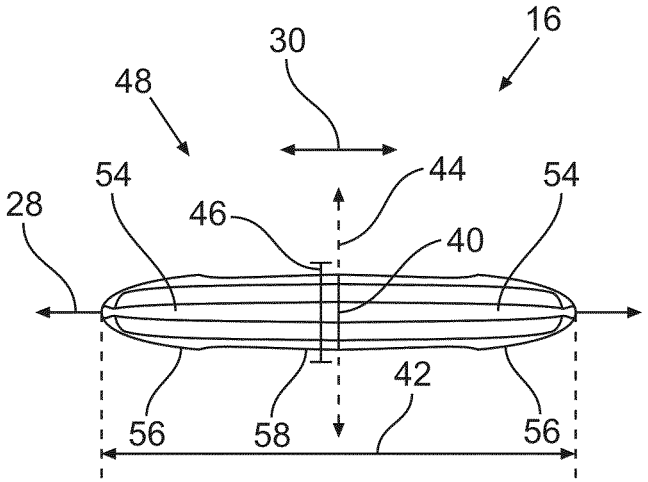
Figure 1H:
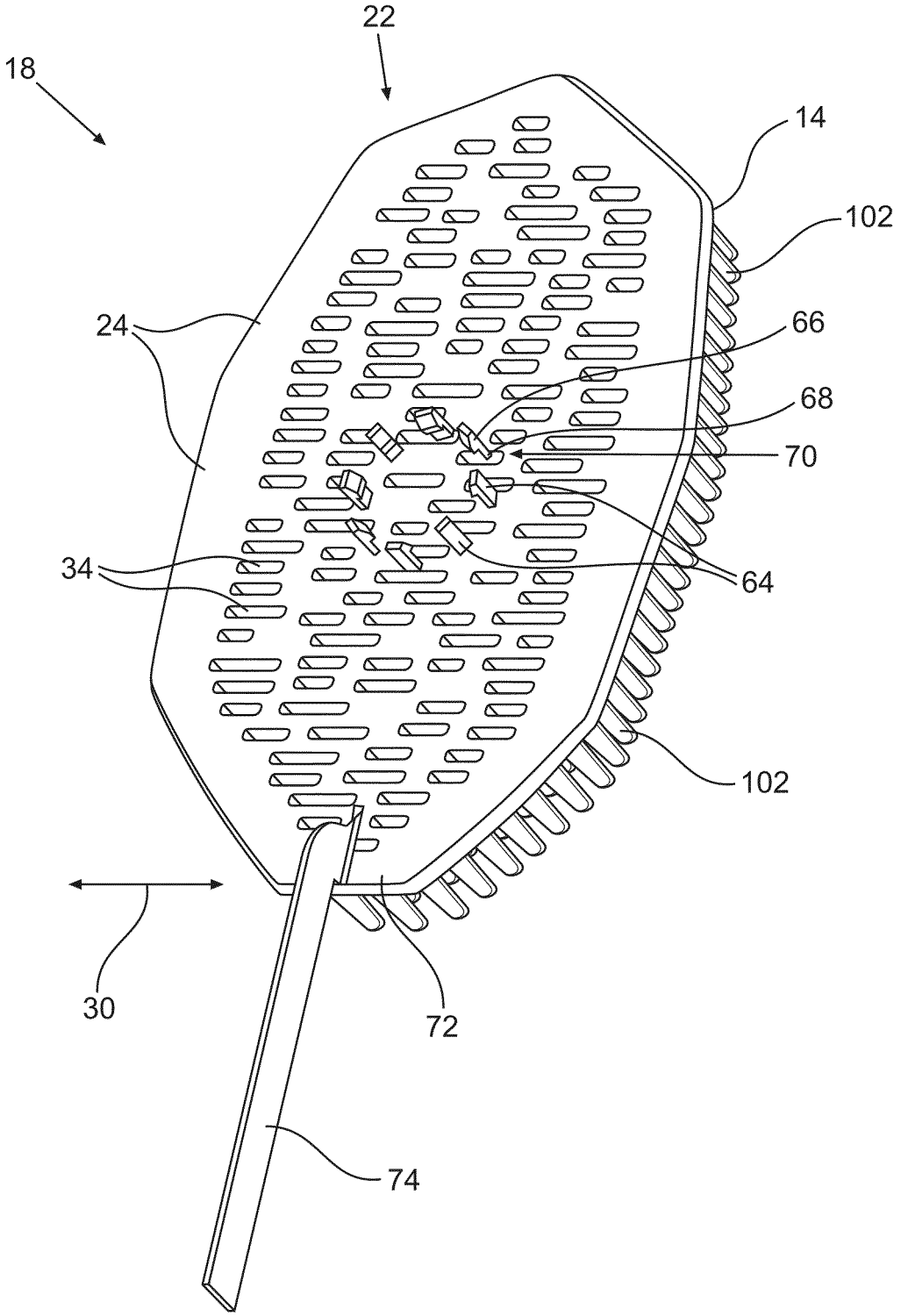
Figure 1I:
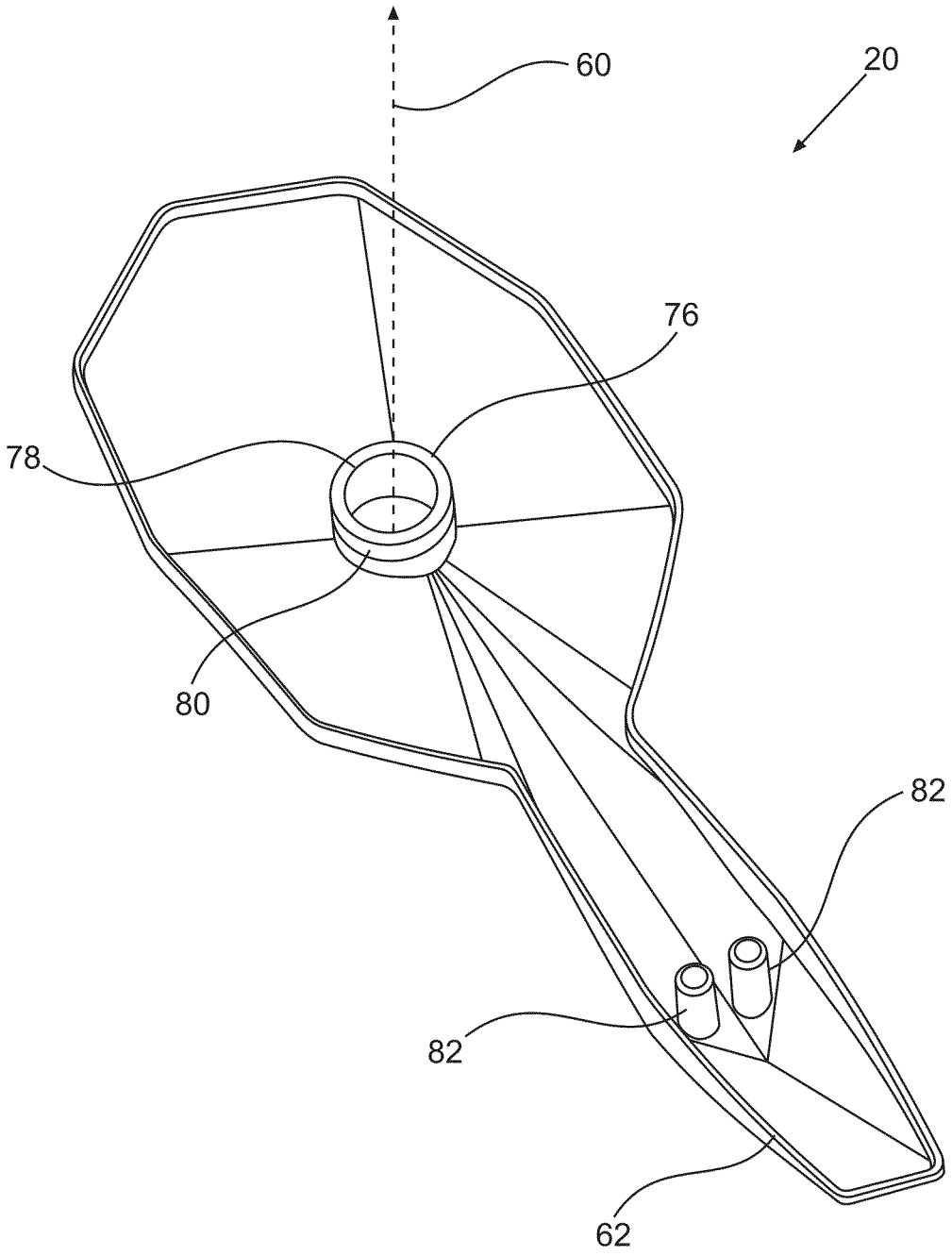
Figure 1J:
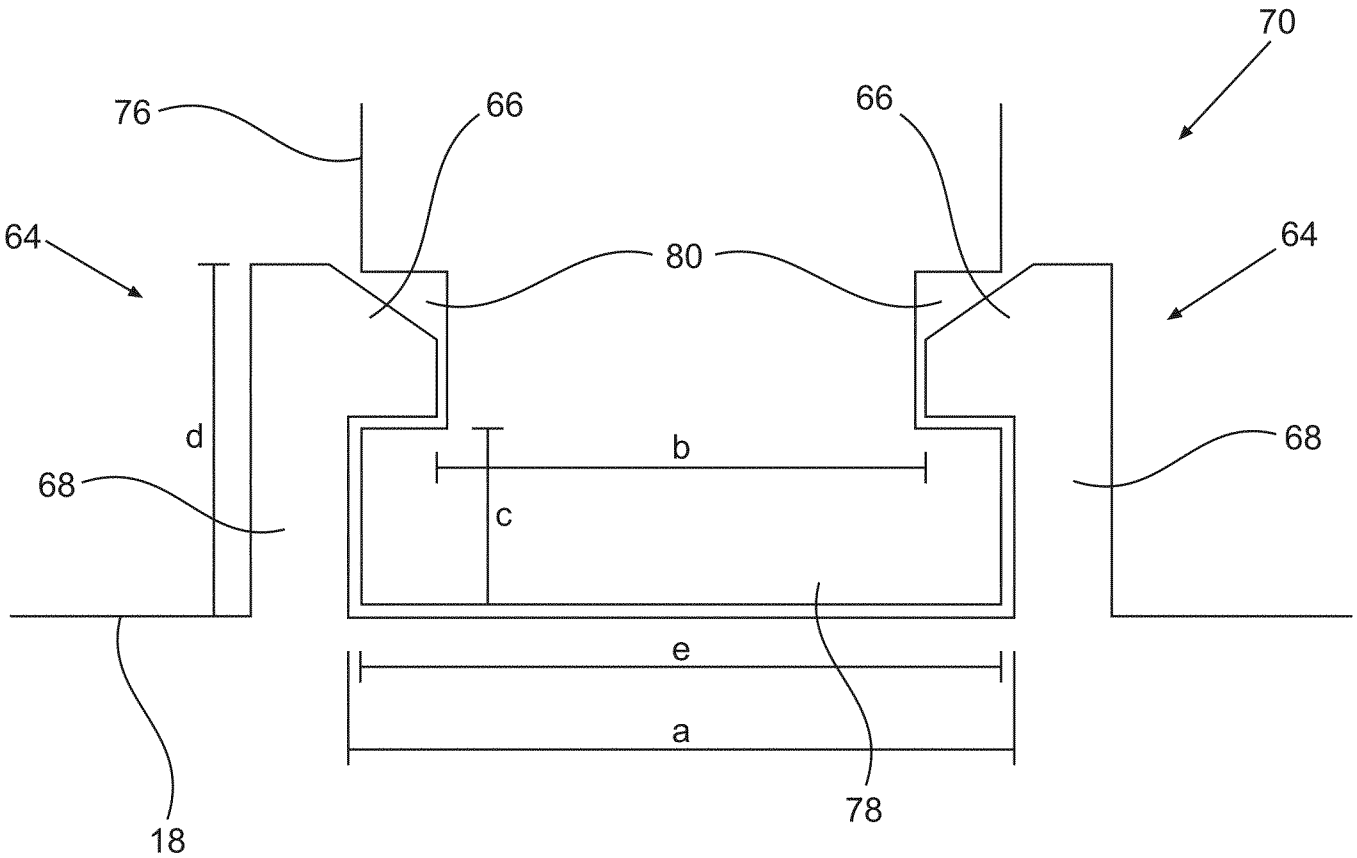

A first device 10 according to an embodiment of the teachings herein that is configured for combing hair is schematically depicted in FIGS. 1A-1J:

FIG. 1A isometric view facing the front of a device body 12 and a styling surface 14;

FIG. 1B, in parallel to the plane of styling surface 14 (end view);

FIG. 1C, perpendicularly to styling surface 14 (front view);

FIG. 1D, a single combing tooth 16 in isometric view;

FIG. 1D', a single variant combing tooth 16 in isometric view;

FIG. 1E, a single combing tooth 16 in side view;

FIG. 1F, a single combing tooth 16 in top view;

FIG. 1G, a single combing tooth 16 in front view;

FIG. 1H, a backing component 18 that defines styling surface 14 and bears teeth 16, from behind;

FIG. 1I, a body component 20 that mates to backing component 18; and FIG. 1J, side cross section showing details of the connection of backing component 18 with body component 20.

Styling surface 14 that is physically associated with device body 12 is a convex polygon having a periphery 22 with nine peripheral edges 24. Distributed on styling surface 14 in an irregular and non-linear fashion is a plurality of one-hundred and thirty eight individual combing teeth 16. Each tooth 16 is fixedly attached to styling surface 14 through a respective tooth base 26 so as to protrude perpendicularly from styling surface 14. As seen in FIG. 1C, the length axes 28 of combing teeth 16 are all parallel and define a combing direction 30 of styling surface 14.

Figure 2A:
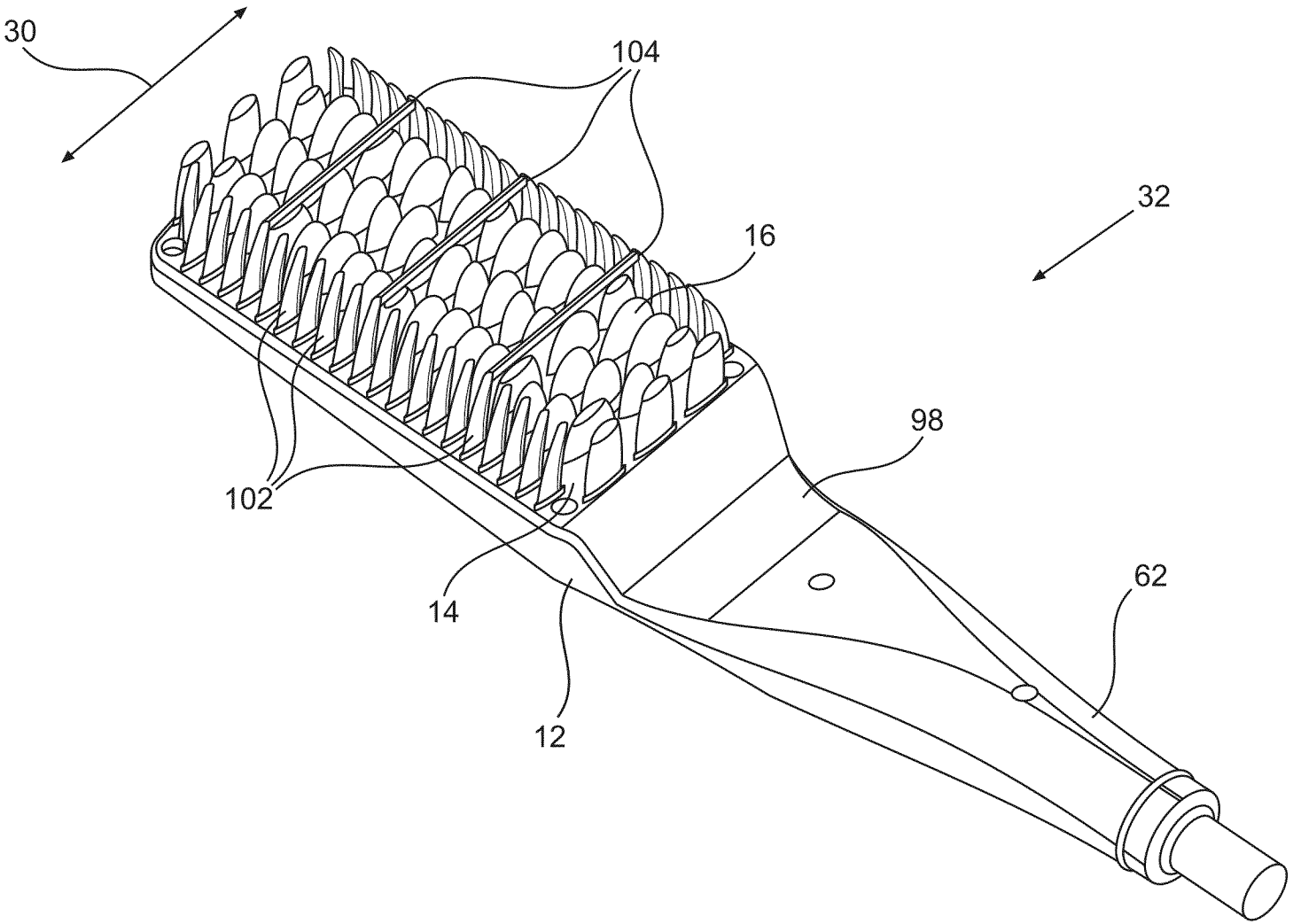
FIGS. 2A to 2G schematically depict an embodiment of a device according to the teachings herein suitable for straightening hair.
Figure 2B:
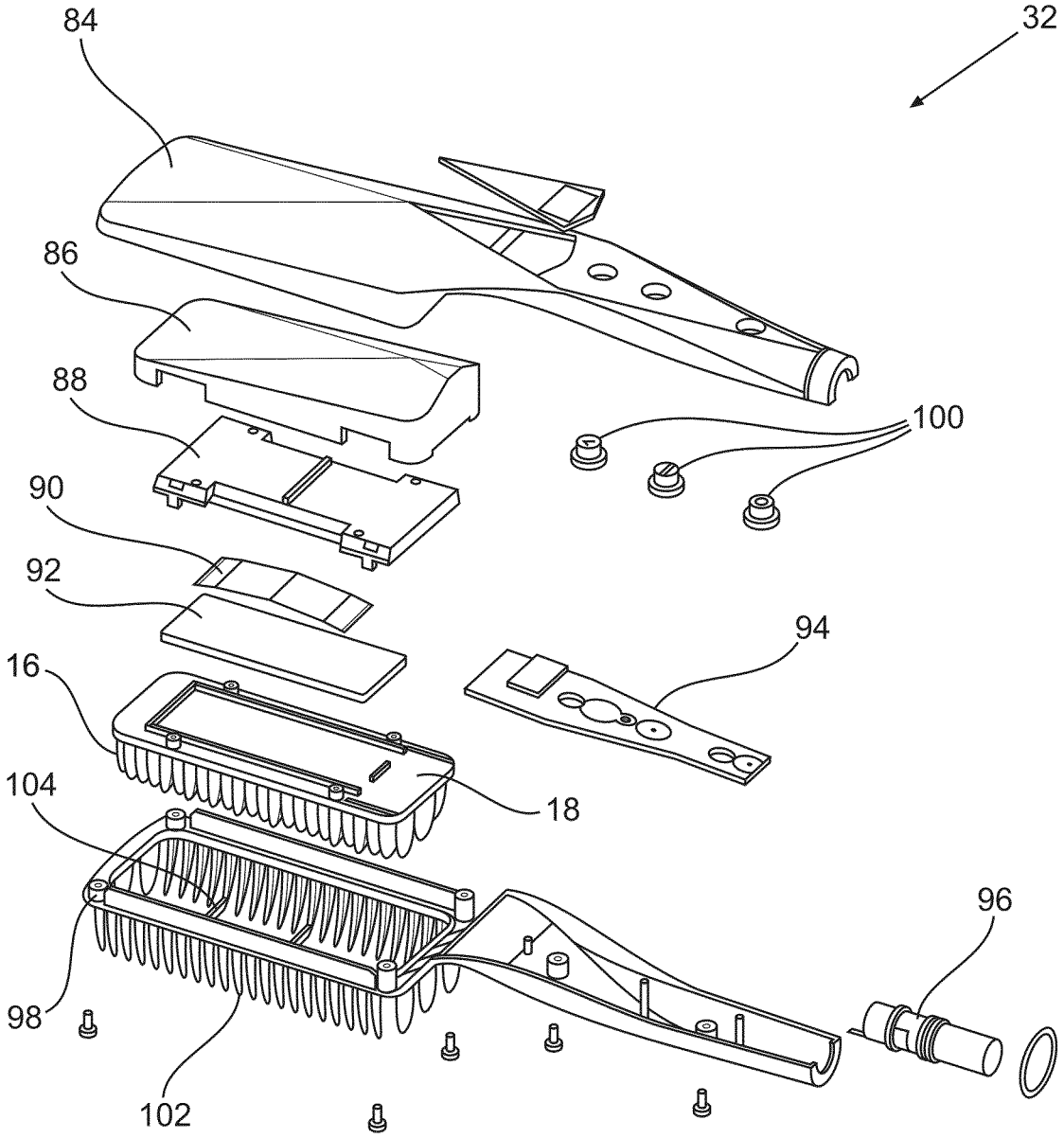
Figure 2C:
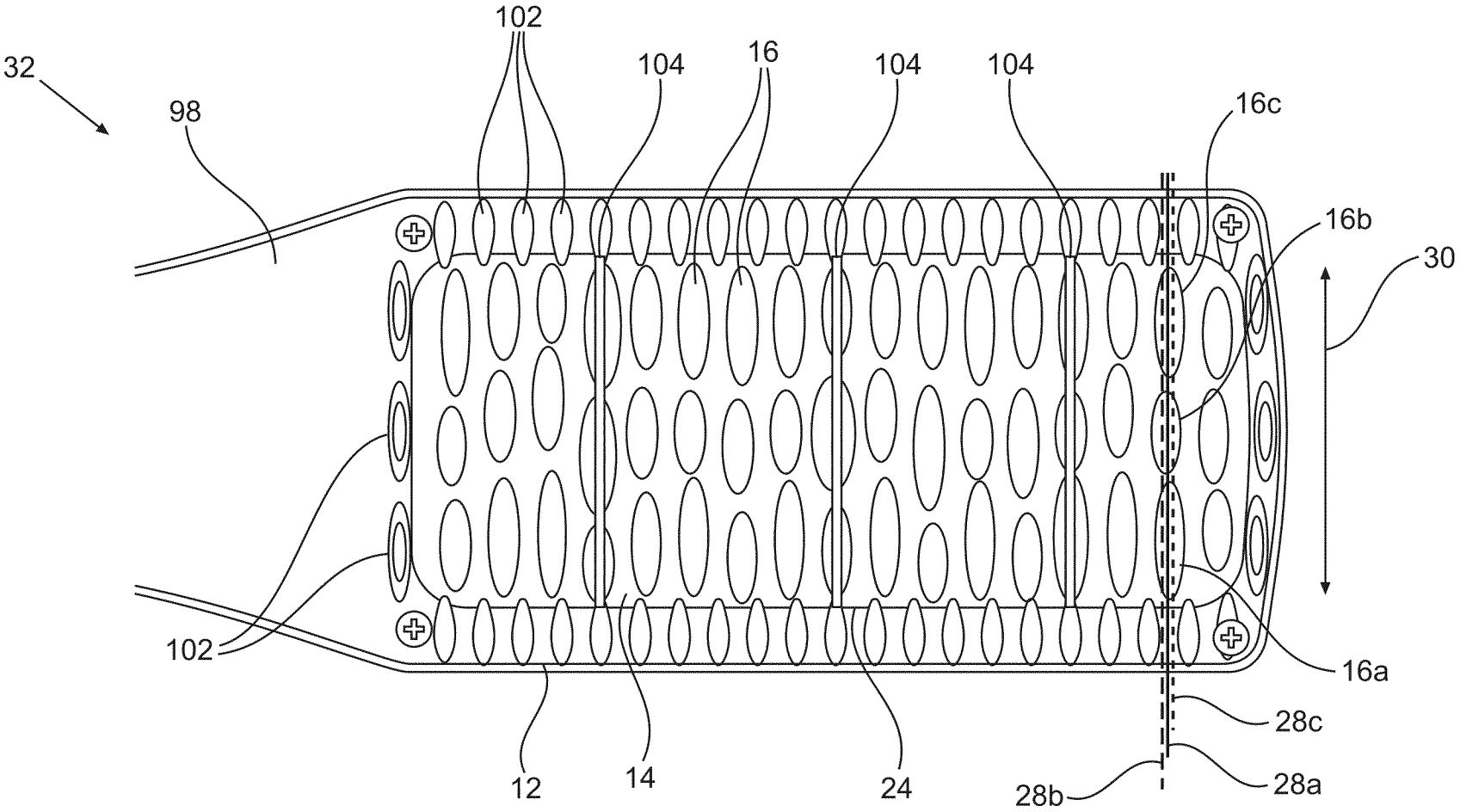
Figure 2D:
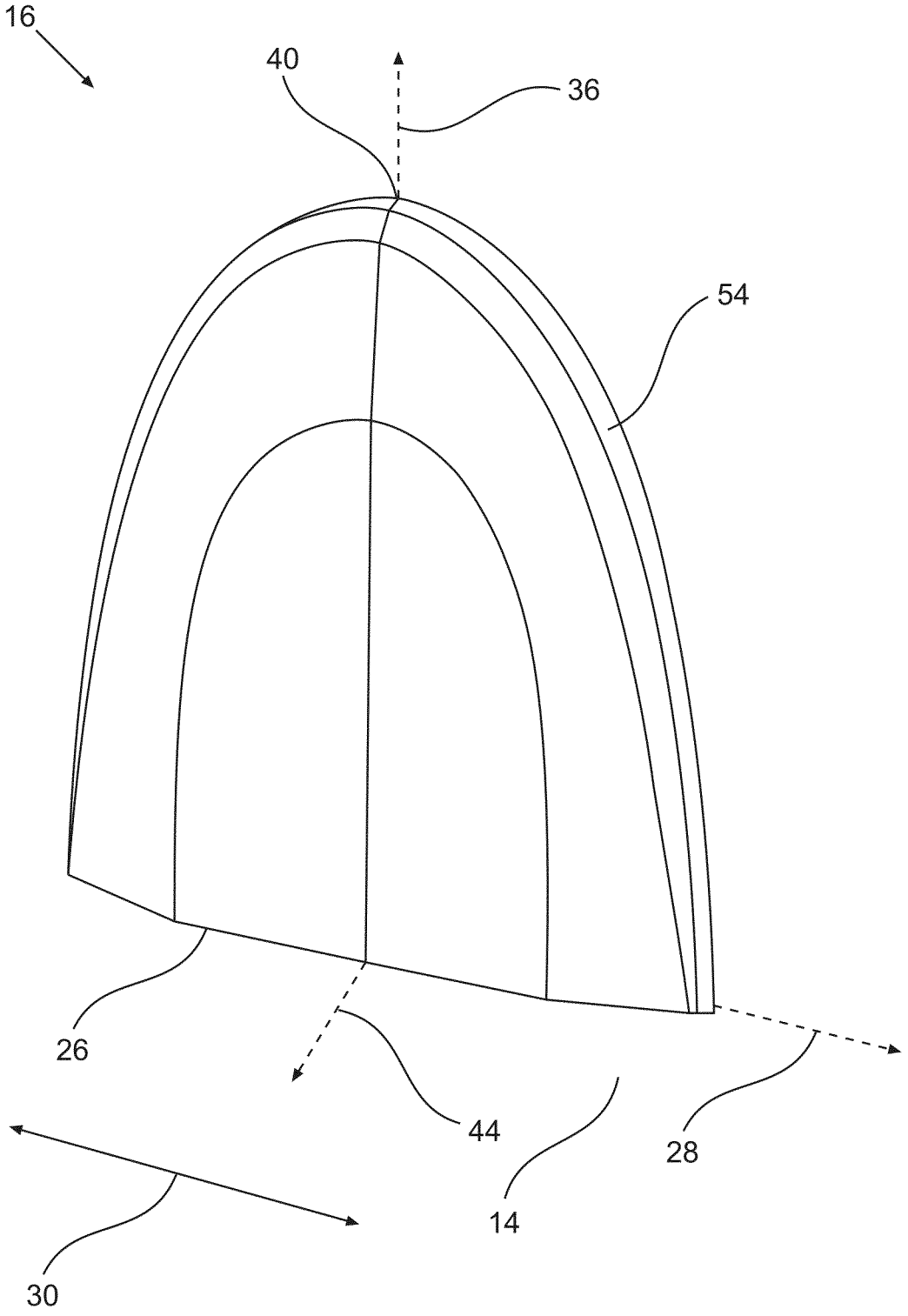
Figure 2E:
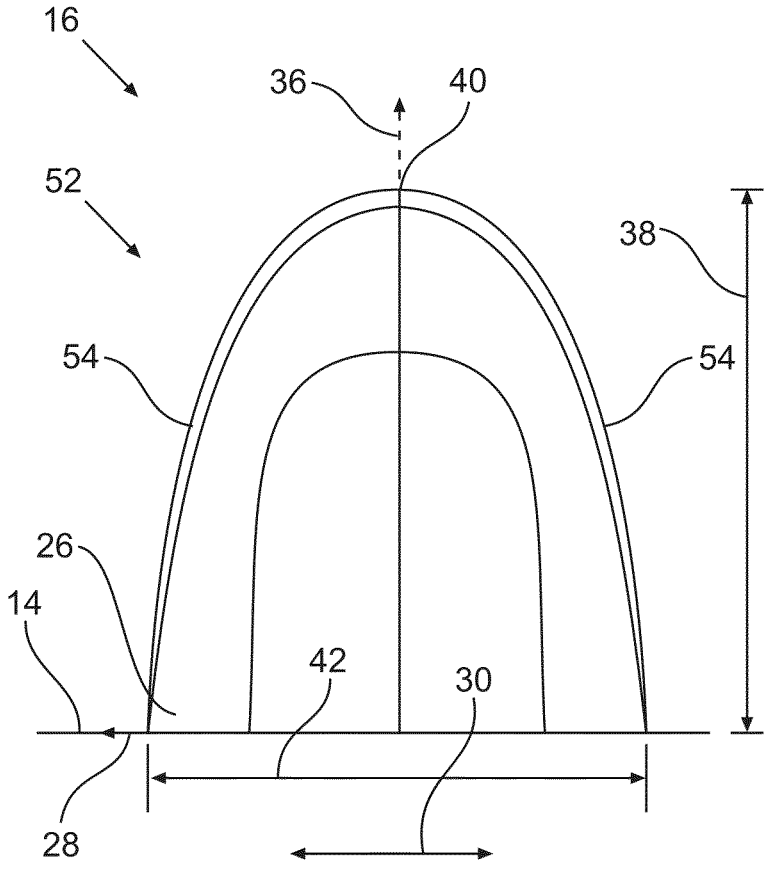
Figure 2G:
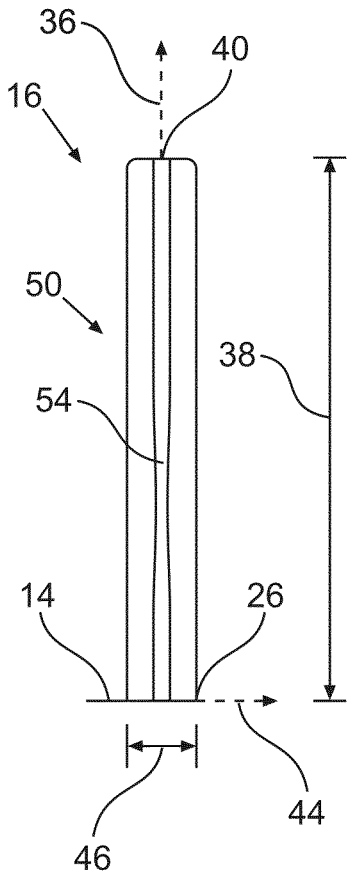
Figure 2F:
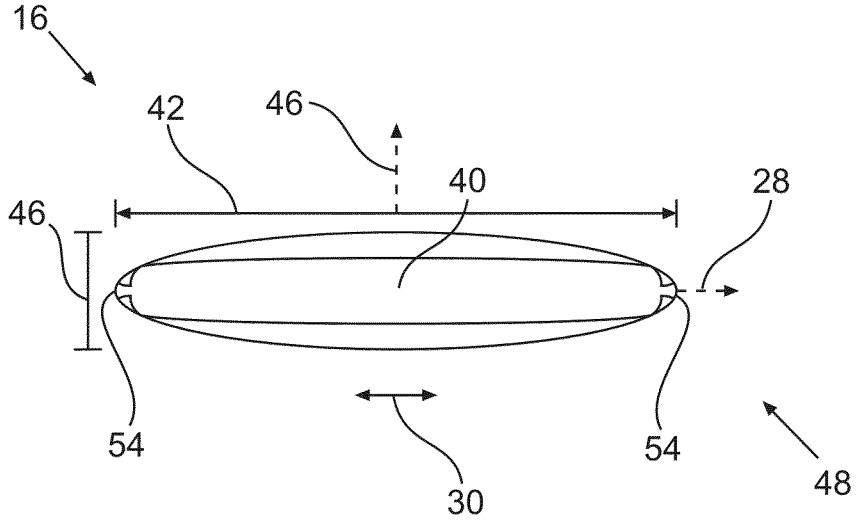

A second device 32 according to an embodiment of the teachings herein that is configured for straightening hair is schematically depicted in FIGS. 2A-2G:

FIG. 2A isometric view facing the front of a device body 12 and a styling surface 14;

FIG. 2B, schematic exploded view depicting components of device 32;

FIG. 2C, perpendicularly to styling surface 14 (front view);

FIG. 2D, a single combing tooth 16 in isometric view;

FIG. 2E, a single combing tooth 16 in side view;

FIG. 2F, a single combing tooth 16 in top view; and

FIG. 2G, a single combing tooth 16 in front view.

In device 32, a styling surface 14 physically associated with a device body 12 is a convex polygon having a periphery 22 with four peripheral edges 24. Distributed on styling surface 14 in an irregular and non-linear fashion is a plurality of fifty-one individual combing teeth 16, each tooth 16 fixedly attached to styling surface 14 through a respective tooth base 26 so as to protrude perpendicularly from styling surface 14. As seen in FIG. 2C, the length axes 28 of combing teeth 16 are all parallel and define a combing direction 30 of styling surface 14.

Distribution of Combing Teeth on Styling Surface

In some embodiment, the teeth of the plurality of at least ten combing teeth are distributed on the styling surface in an irregular fashion, that is to say, the device comprises an irregular distribution of combing teeth (some of which embodiments are referred to by the terms "random", "semi-random", "sporadic", "non-homogenous" or "non-periodic" distribution in the priority documents). Depending on the embodiment and as detailed below, the irregular distribution is achieved, inter alia, by differing sizes of the combing teeth, differing shapes of the combing teeth and differing spacing between any two combing teeth.

In some embodiments, the teeth of the plurality of at least ten combing teeth are distributed on the styling surface in a non-linear fashion. By "non-linear fashion" is meant, as depicted in FIGS. 1C and 2C (as well as marked in detail in 2C), that for each specified combing tooth 16*a* having a length axis 28*a*, there are at least two different combing teeth 16*b* and 16*c* which length axes 28*b* and 28*c* are parallel and within a distance of 2 mm of, but not colinear with, the length axis 28*a* of the specified combing tooth 16*a*. In some embodiments, the length axes are within a distance of 1.5 mm, 1.2 mm and even within a distance of 1 mm.

It has been surprisingly found that an irregular and/or a non-linear distribution of combing teeth that are longer than wide on the styling surface allows for more effective release of tangles during combing. Without wishing to be held to any one theory, it is currently believed that such distribution of combing teeth provides multiple non-linear combing paths for the individual hairs, each path having a substantial linear portions (when passing in parallel to a combing tooth as a result of the length of the tooth) and in some embodiments having a width that varies along the length of the path. In the priority documents, some embodiments of such linear portions are referred to as "misaligned hair passage segments" or "hair passage trajectories", In the priority documents, some embodiments of such non-linear combing paths are referred to as "non-uniform hair passage trajectories", As a result, each such combing path is subtly different in terms of with what forces and at what angle hair and especially a tangle is engaged by the leading edge of the combing tooth. It is currently believed that the different combing paths lead to many different interaction geometries between hair and tangles and a leading edge of a combing tooth; when combing with a device according to the teachings herein a specific tangle is eventually engaged by a combing tooth in an interaction geometry that is specifically suited for combing the hair while releasing the tangle rather than tearing the hair. Additionally and without wishing to be held to any one theory, it is currently also believed that such distribution of combing teeth also provides a subtle variation of stretching, bending and torquing forces that straightens hair passing through combing paths. Application of sufficient heat applied while the hairs are straightened in such a way leads to "setting" of the straightening of the hair in accordance with embodiments of the teachings herein.

Combing Teeth

As noted above, a device according to the teachings herein has a plurality of at least ten combing teeth where each tooth is fixedly attached to the styling surface. A single combing tooth 16 of device 10 is depicted in FIGS. 1D, 1E, 1F, 1G and a single combing tooth 16 of device 32 is depicted in FIGS. 2D, 2E, 2F, 2G.

Attachment of Combing Teeth to Styling Surface

As seen in the figures, each tooth 16 is fixedly attached to styling surface 14 through a respective tooth base 26 so as to protrude perpendicularly from styling surface 14. In some embodiments such as devices 10 and 32, all the combing teeth are in a fixed position on the styling surface relative one to the other.

In some embodiments, the combing teeth are distinct components separate from the styling surface. For example, in FIG. 1H, backing component 18 of device 10 that defines styling surface 14 as well as each combing tooth 16 are separately molded from a suitable polymer, and combing teeth 16 are subsequently placed into appropriately sized slots 34 passing through backing component 18. In some such embodiments, combing teeth 16 are fixedly attached in place in slots 34 (and consequently to styling surface 14) by tension. Additionally or alternatively, in some such embodiments, combing teeth 16 are held in place in slots 34 with the use of adhesive and/or by welding.

In some embodiments, the combing teeth are integrally formed with the styling surface. For example, in device 32, combing teeth 16 and styling surface 14 are both portions of a monolithic block of cast aluminum. In some embodiments, similar to device 10, the combing teeth 16 and styling surface 14 are both portions of a monolithic polymer block.

Details of Combing Teeth

As noted above and seen in FIGS. 1D, 1E, 1F, 1G, 2D, 2E, 2F, 2G, each combing tooth 16 of a device according to the teachings herein has:

i. along a height axis 36 perpendicular to styling surface 14, a height 38 measured from a base 26 of the tooth 16 at styling surface 14 to a respective tooth tip 40, ii. along a length axis 28 of the tooth 16 on styling surface 14, a length 42, iii. along a width axis 44 on styling surface 14 and perpendicular to the length axis 28, a width 46, the width 46 being less than the length 42, iv. a top cross section 48 in a plane including the width axis and the length axis, v. a front cross section 50 in a plane including the width axis and the height axis, and vi. a side cross section 52 in a plane including the length axis and the height axis.

Combing teeth of a device according to the teachings herein are elongated (i.e., having a width less than a length) but are not filamentous.

Side Cross Section of Combing Teeth

Embodiments of combing teeth 16 are schematically depicted from the side in FIGS. 1E and 2E so that the respective side cross sections 52 are apparent.

Height

Combing teeth 16 are of any suitable height 38. In the priority documents, the term "height" was referred to as length. In some embodiments, the height 38 of combing teeth 16 is not less than 10 mm and not more than 25 mm. In some embodiments, the height is not less than 13 mm, not less than 15 mm and even not less than 17 mm. In some embodiments, the height is not more than 24 mm, not more than 22 mm and even not more than 20 mm. In some preferred embodiments, the height of the combing teeth is between 17 and 20 mm. It is important to note that the specific combing tooth heights recited hereinabove are not arbitrary values: the height of the combing teeth of a device influence the tangle-leading edge interaction geometry so that in some embodiments the recited heights provide advantageous combing results.

Length

Combing teeth 16 are of any suitable length 42. In some embodiments, the length 42 of combing teeth 16 is not less than 2 mm and not more than 25 mm. In some embodiments, the length is not less than 3 mm, not less than 4 mm and even not less than 5 mm. In some embodiments, the length is not more than 23 mm, not more than 20 mm and even not more than 18 mm. In some preferred embodiments, the length of the combing teeth is not less than 5 mm and not more than 18 mm, and in some embodiments not less than 8 mm and not more than 18 mm. It is important to note that the specific combing tooth lengths recited hereinabove are not arbitrary values: the length of the combing teeth of a device influence the tangle-leading edge interaction geometry so that in some embodiments the recited lengths provide advantageous combing results.

Arching

In some embodiments, at least one side of a side cross section 52 of a combing tooth 16 arches upwards from tooth base 26 to tooth tip 40 (a shape that, depending on the embodiment, may also be referred to as "tooth-like", tooth-shape", fin-like", "fin shaped" or "arctuate" and "arctuate arctuate element"). In some preferred embodiments, both sides of a side cross section 52 of a combing tooth 16 arch upwards from base 26 to tip 40, so that a length 42 at tooth base 26 is the longest part of side cross section 52. As a result of such arching, the tangential angle of leading edge 54 measured relative to styling surface 14 changes along height axis 36, e.g., from close to 90° close to styling surface 14 to 90° at tip 40.

It has been found that in some embodiments, such arching provides advantages, in some embodiments one or both of less tearing of hair and increased tangle-release. Without wishing to be held to any one theory, it is currently believed that the advantages are a result of the change in geometry of interaction between a tangle and a leading edge 54 of a combing tooth 16 allowed by such arching, as the geometry of interaction is determined, inter alia, by the combing paths in which the hair constituting the tangle is found and the angle of leading edge 54 where the tangle contacts leading edge 54. Specifically, during combing, a tangle contacts a leading edge 54 of a combing tooth 14. It is believed that if the geometry of interaction between the tangle and leading edge 54 is suitable, the tangle is released with a force that is insufficient to tear the hair. If the tangle is not released, instead of the hair tearing as a result of excessive applied force, the tangle rides upwards along leading edge 54. Such upwards motion substantially changes the tangle-leading edge geometry of interaction and may release the tangle. If the tangle is not released, instead of tearing hair, the tangle rides up to and past tooth tip 40.

In some such embodiments (e.g., combing teeth 16 of devices 10 and 32), the arching begins immediately at base 26. In some embodiments, the arching begins at a distance from styling surface 14, in some embodiments not more than 3 mm, not more than 2 mm and even not more than 1 mm from styling surface 14. In some embodiments, the arching begins at a distance from styling surface 14 that is not more than 30%, not more than 20% and in some embodiments not more than 10% of height 38 of combing tooth 16 from styling surface 14.

In some embodiments, the arching is to a point, e.g., side cross section 52 resembles a pointed, ogival or lancet arch.

In some embodiments (e.g., devices 10 and 32), the arching is to a continuous rounded curve, e.g., side cross section 52 resembles a round arch. In some embodiments, such arching is to a parabolic curve, e.g., side cross section 52 resembles a parabolic arch. In some embodiments, such tapering is a circular curve, e.g., side cross section 52 resembles a circular arch.

In some embodiments, the side cross section of a combing tooth is a shape selected from the group consisting of semi-elliptical, circular, parabolic, truncated oval, truncated loop and parabolic-like. In some embodiments, the side cross section of a combing tooth is substantially polygonal geometry (e.g., has a rectangular shape).

Generally, arching to a continuous rounded curve is preferred to arching to a point as it is believed that a continuous rounded curve has a reduced change of tearing hair.

Solid and Hollow Combing Teeth

In some embodiments, at least some of the combing teeth have a solid side cross section 52, e.g., combing tooth 16 of device 32 (in the priority documents also called "full-body" geometry). In some embodiments, at least 50%, at least 80% and even at least 95% of the combing teeth 16 of a device have a solid side cross section. In some embodiments, all of the combing teeth of a device have a solid side cross section e.g., device 32. In some embodiments, combing teeth having a solid side cross section are preferred due to a greater rigidity and due to definition of a combing path along the outer surface of the combing tooth that assists in releasing tangles. As discussed in greater detail below, in embodiments of the device configured for straightening hair, combing teeth with a solid side cross section more effectively transfer sufficient heat to cause a desired straightening effect.

In some embodiments, at least some of the combing teeth have a hollow side cross section 52 comprising legs 56 that at least partially define leading edge 54 and a hollow 58 between legs 56, e.g., combing tooth 16 of device 10 (in the priority documents also called "frame-like geometry", "holed", "semi-looped", "hollow"). In some embodiments, at least 50%, at least 80% and even at least 95% of the combing teeth of a device have a hollow side cross section. In some embodiments, all of the combing teeth of a device have a hollow side cross section e.g., device 10. In some embodiments, combing teeth having a hollow side cross section are preferred due to a greater flexibility as discussed hereinbelow.

Top Cross Section of Combing Teeth

Embodiments of combing teeth 16 are schematically depicted from the top perpendicularly to styling surface 14 in FIGS. 1F and 2F so that the respective top cross sections 48 are apparent. The top cross section of a combing tooth is, on occasion, also referred to as the "pace" of the combing tooth.

Width

Combing teeth 16 are of any suitable width 46. In some embodiments, the width 46 of combing teeth 16 is not less than 0.8 mm and not more than 6 mm. In some embodiments, the width is not less than 1 mm, not less than 1.4 mm and even not less than 1.5 mm. In some embodiments, the width is not more than 5 mm, not more than 4 mm and even not more than 3 mm. In some preferred embodiments, the width of the combing teeth is between 1.5 and 2 mm. It is important to note that the specific combing tooth widths recited hereinabove are not arbitrary values: the width of the combing teeth of a device influences the tangle-leading edge interaction geometry so that in some embodiments the recited widths provide advantageous combing results.

In some preferred embodiments of a device configured for combing hair, the width of the combing teeth is between 0.7 mm and 3.0 mm, and even between 0.8 mm and 2.5 mm.

In some preferred embodiments of a device configured for straightening hair, the width of the combing teeth is between 1.5 mm and 5 mm, and even between 2 mm and 4 mm.

Leading Edge

Together with the width 46, the shape of top cross section 48 of a combing tooth 16 in a large part defines the shape of the leading edge 54 of the combing tooth 16. The shape of the leading edge 54 is an important influence on the tangle-leading edge interaction geometry. Accordingly, a top cross section 48 of a combing tooth 16 is any suitable shape.

In some embodiments, from at least one end of a top cross section 48 of a combing tooth 16, the dimensions of the top cross section 48 increase from a narrow portion at leading edge 54 to a wider portion towards width axis 44. In some preferred embodiments, from both ends of a top cross section 48 of a combing tooth 14, the dimensions of the top cross section 48 increase from a narrow portion at either leading edge 54 to a wider portion towards width axis 44. In some preferred embodiments of combing teeth having a solid side cross section, the widest portion of the combing tooth 16 is at the width axis 44, and in some such embodiments the width increases monotonously from a narrow portion at a first leading edge 54 to a widest portion at width axis 44, and then decreases monotonously to a narrow portion at a second leading edge 54, as depicted in FIG. 2F.

In some embodiments, a top cross section 48 of a combing tooth is pointed at at least one leading edge 54 so that the leading edge 54 is sharp, e.g., resembles a pointed, ogival or lancet arch. In some embodiments, a top cross section 48 of a combing tooth is pointed at both leading edges 54 so that both leading edges 54 are sharp.

In some embodiments, a top cross section 48 of a combing tooth 16 has a continuous rounded curve at at least one leading edge 54 so that the leading edge 54 is rounded, e.g., resembles a round arch such as a parabolic or circular arch. In some embodiments, a top cross section 48 of a combing tooth 16 has a continuous rounded curve at both leading edges 54 so that both leading edges 54 are rounded.

Generally, a rounded leading edge is preferred to a pointed leading edge as it is believed that a rounded leading edge has a reduced chance of damaging hair and an increased ability to release tangles and/or to allow a tangle to rise up and off the tooth comb to reduce the chance of tearing the hair.

Front Cross Section of Combing Teeth

Embodiments of combing teeth 16 are schematically depicted from the front perpendicularly to combing direction 30 in FIGS. 1G and 2G so that the respective front cross sections 50 are apparent.

A front cross section 50 of combing teeth 16 is of any suitable shape.

In some embodiments (e.g., device 32), the front cross section is parallel-walled so that the sides of combing teeth rise perpendicularly from styling surface 14.

In some embodiments (e.g., device 10), a front cross section 50 tapers from a widest portion at tooth base 26 to a narrower portion towards tooth tip 40. In some embodiments, such taper is modest so that width 46 at tooth base 26 of combing tooth 16 is not more than 1 mm greater than the width of the front cross section 50 at a point 2 mm from the tooth top, and in some embodiments, not more than 0.8 mm, not more than 0.6 mm greater and in some embodiments not more than 0.4 mm greater. It is important to note that in some embodiments, the shape and the degree of taper of the combing teeth have an important influence on the tangle-leading edge interaction geometry.

In some embodiments, a front cross section 50 of a combing tooth 16 is pointed at tooth tip 40, e.g., resembles a pointed, ogival or lancet arch.

In some embodiments, a front cross section 50 of a combing tooth 16 has a continuous rounded curve at tooth tip 40 so that the tooth tip 40 is rounded, e.g., resembles a rounded arch such as a parabolic or circular arch.

In some embodiments, a top cross section 50 of a combing tooth 16 is flat (linear and parallel to styling surface 14) at tooth tip 40, for example, as in device 10. In preferred such embodiments, the top cross section curves to the flat portion at the tooth tip 40.

Generally, a rounded or flat topped front cross section 50 is preferred to a pointed front cross section as it is believed that these have a reduced change of damaging hair and causing discomfort to a scalp.

Rigidity of Combing Teeth

In some embodiments e.g., devices 10 and 32) the combing teeth 16 are rigid in the plane including the side cross section 52 (length axis and the height axis) i.e., do not bend in the combing direction.

In some embodiments (e.g., device 32) at least some of the combing teeth 16 are rigid in the plane including the front cross section 50 (width axis and the height axis), i.e., bend perpendicularly to the combing direction. In some embodiments (e.g., device 32) all of the combing teeth 16 are rigid in the plane including the width axis and the height axis, In some embodiments (especially in embodiments particularly configured for combing, e.g., device 10) at least some of the combing teeth 16 are at least somewhat flexible in the plane including front cross section 50 (the width axis and the height axis), i.e., bend perpendicularly to the combing direction. In some embodiments all of the combing teeth are at least somewhat flexible in the plane including the width axis and the height axis. In some embodiments, such flexibility is primarily along the height of the tooth, in a manner analogous to a flexible rod, for example, in embodiments where the tooth is of a solid elastic material (e.g., an elastic polymer). In some embodiments, such bending is (additionally or primarily) from around the base 26 of the combing tooth 16, for example, by reduction of structural material from the comb tooth near the base thereof, for example as in the combing teeth 16 of device 10 that are hollowed near tooth base 26. Such flexibility, especially when from around the base, is believed to absorb some of the excess force that is applied to hair during combing, assisting in reducing the incidence of tearing of hair.

Spacing

The distance between any two facing combing teeth on the styling surface perpendicular to the combing direction, that is to say, the width of the "valley" between the two combing teeth is any suitable distance. In some preferred embodiments, the distance between any two facing combing teeth as measured between the respective bases along the styling surface in perpendicular to the combing direction is not less than 0.9 mm and not more than 5 mm. In some embodiments, the distance is not less than 1.0 mm, not less than 1.1 mm and even not less than 1.2 mm. In some embodiments, the distance is not more than 4.5 mm and even not more than 4.0 mm. It is important to note that in some embodiments the distance between facing teeth is not an arbitrary distance. Without wishing to be held to any one theory, it is currently believed that in some embodiments, if the distance is too small, there is a greater chance that a tangle will be caught and tightened to a knot or too much tension will be applied to a hair, and if the distance is too great, the density of the comb teeth may be too low for effective combing. Additionally and without wishing to be held to any one theory, it is currently also believed that in embodiments configured for the straightening of hair, when the distance between two facing combing teeth is too great, hair that passes between two combing teeth is stretched less effectively leading to somewhat less efficient setting of the hair. Additionally and without wishing to be held to any one theory, it is currently also believed that in some embodiments of devices configured for straightening hair where the combing teeth have a curved top cross section (from a narrow first leading edge, widening towards the center, then narrowing towards the second leading edge), the combing paths have widths that vary within the ranges recited above. The individual strands making up a bundle of hairs that is draw through such a combing path are compressed when passing through narrow portions of the combing paths, in a manner that assists in straightening the hair without requiring clamping as known in the art.

It has recently been found and is hereby disclosed that in some embodiments of devices configured for straightening hair it is preferable that the minimal distance between any two facing combing teeth as measured between the respective bases along the styling surface in perpendicular to the combing direction is not more than 1.3 mm, not more than 1.2 mm, not more than 1.1 mm and even not more than 1.0 mm. In some such embodiments the minimal distance is not less than 0.3 mm and not more than 1.3 mm, not more than 1.2 mm, not more than 1.1 mm and even not more than 1.0 mm, In some such embodiments, the minimal distance is not less than 0.4 mm. It has also been found that the distance between the leading edges of the teeth along the periphery of the styling surface is preferably relatively large, in some embodiments not less than 3 mm and not more than 6 mm, preferably not less than 3.5 mm, not less than 3.7 mm and even not less than 3.9 mm and preferably not more than 5.5 mm, not more than 5.3 mm and even not more than 5.1 mm (e.g., 4 mm or 5 mm).

Without wishing to be held to any one theory, such configuration allows a bundle of hair to enter a combing path having a relatively wide entrance (the distance between the leading edges of the teeth along the periphery of the styling surface. The bundle then passes through the heated combing path (the "valley" between the teeth) that narrows from a broad between 3 mm to 6 mm, e.g., 4 mm or 5 mm) to a narrowest point of between 0.3 mm to 1.3 mm (e.g., 0.4 mm to 1.0 mm). The combination of heat radiated by the teeth and/or styling surface, the shape of the path defined by the shape of the teeth that assists in stretching the hair strands and the pressure applied to the hair strands by compression of the hair bundle going from a broad to a narrow portion has been shown to effectively straighten hair.

The narrowing of the combing path from the leading edges of teeth to the narrowest points is achieved by the width of teeth as discussed above which are between 1.5 mm and 5 mm and even between 2 mm and 4 mm. For example, in embodiments where the distance between leading edges is 4 mm and the width of the teeth is 3 mm, the width of the combing path at the narrowest point is approximately 1 mm and in embodiments where the distance between leading edges is 5 mm and the width of the teeth is 4 mm, the width of the combing path at the narrowest point is approximately 1 mm.

In contrast, in some embodiments that relate primarily to combing hair and loosening tangles, it is preferable that the minimal distance between any two facing combing teeth as measured between the respective bases along the styling surface in perpendicular to the combing direction is as discussed above, e.g., not less than 1.2 mm, for example between 1.5 mm and 3 mm, or between 1.6 mm and 2.5 mm, or between 1.7 mm and 2.2 mm.

Types of Combing Teeth

In some embodiments, substantially all of the combing teeth of a device are identical.

In some embodiments, the device has a number of different populations of combing teeth, all combing teeth of a given population being identical and different from combing teeth of a different population, wherein the number is at least two, at least three, at least four, at least five and in some embodiments even at least six. In some embodiments, each population includes at least 4, at least 6, at least 8, and even at least 10 combing teeth. The different populations of combing teeth 16 of device 10 are especially apparent in FIG. 1C where there are nine different populations of teeth, and of device 32 are especially apparent in FIG. 2C.

In some embodiments, the combing teeth of one population have a height different from that of the combing teeth of a different population. For example, in FIG. 1B, it is seen that there exist combing teeth 16*d* that are about 2 mm longer than other combing teeth. In some embodiments, a single device comprises 2, 3, 4, 5, 6, 7 and even more than 7 different populations of combing teeth, the combing teeth of each such population having a height different from those of the other populations.

In some embodiments, the combing teeth of one population have a length different from that of the combing teeth of a different population. In some embodiments, a single device comprises 2, 3, 4, 5, 6, 7 and even more than 7 different populations of combing teeth, the combing teeth of each such population having a length different from those of the other populations.

In some embodiments, the combing teeth of one population have a width different from that of the combing teeth of a different population. In some embodiments, a single device comprises 2, 3, 4, 5, 6, 7 and even more than 7 different populations of combing teeth, the combing teeth of each such population having a width different from those of the other populations.

In some embodiments, the combing teeth of one population have a side cross section different from that of the combing teeth of a different population, for example, a different curvature towards the tooth tip. In some embodiments, a single device comprises 2, 3, 4, 5, 6, 7 and even more than 7 different populations of combing teeth, the combing teeth of each such population having a side cross section different from those of the other populations.

Multiple populations of combing teeth allow a great variation in the details of interaction between a hair and a specific combing tooth as well as a greater variety of different combing paths.

For example, all things being equal, taller combing teeth penetrate more deeply into the hair, and remain in contact with a tangle for longer before the tangle slips off the tip of the combing tip.

For example, all things being equal, a combing tooth with a more acute curvature applies greater force to a hair or tangle than does a combing tooth with a less acute curvature.

In some embodiments, the combing teeth of a given population are distributed over the styling surface, as opposed to concentrated in one portion of the styling surface. In some such embodiments, not more than 30%, not more than 20% and even not more than 10% of combing teeth are adjacent to another member of the same population.

In some preferred embodiments, especially such embodiments configured for straightening hair, the widths and the heights of all the combing teeth are substantially the same, but there are multiple populations, each population having a different length and concomitantly a different side cross section.

In some preferred embodiments, especially such embodiments configured for combing hair, the widths of all the combing teeth are substantially the same and there are at least three (preferably at least four, at least five, at least six, and even at least seven) populations, each such population having the same height but a different length and concomitantly a different side cross section, and an additional one or two (preferably one) population of teeth that are shorter than the rest but also higher than the rest (typically by no more than 2 mm).

Styling Surface

The styling surface is any suitable styling surface having any suitable shape and size. In the priority document, some instances of a styling surface are referred to as "brushing surface" or "hair brushing surface".

In some embodiments (e.g., devices 10, 32), styling surface 14 is planar, that is to say, has a linear cross section both parallel and perpendicular to the combing direction.

In some embodiments (e.g., device 10, 32), styling surface 16 is convexly curved, that is to say, has a linear cross section perpendicular to the combing direction but a curved cross section in parallel to the combing direction, where the combing teeth protrude from the outwardly curved side of the styling surface. In some such embodiments, the styling surface is a circle in cross section in parallel to the combing direction, analogous to a circular hair brush known in the art.

In some embodiments, the width of the styling surface as measured in parallel to the combing direction when viewed perpendicularly to the styling surface is not less than 3 cm and not more than 10 cm.

The periphery of the styling surface is any suitable periphery, typically a convex closed curve. In some embodiments, the shape of the periphery of the styling surface is selected from the group of convex closed curves selected from the group consisting of a circle, an oval, an ellipse, a polygon, a triangle, a pentagon, a hexagon and a rectilinear polygon. In some embodiments, at least a portion of the styling surface is parabolic. In some embodiments, a rectilinear polygon shape, especially embodiments suitable for straightening of hair, is preferred as such are believed to provide the most uniform effect on all hair contacted by the device.

As discussed herein, the styling surface of a device according to the teachings herein is typically defined by a component such as backing component 18. In the priority documents, some embodiments of a styling surface are defined by a component called "retention plate".

Device Body

The device body of a device according to the teachings herein is any suitable device body. The device body, as well as other components of the device, are made of any suitable material using any suitable technique. In some embodiments, a device body and other components are made of a polymer selected from the group consisting of ABS, polyester (e.g., Nylon), polycarbonate, polyethylene, polymethylmethacrylate, polypropylene, polyurethane, polyvinylchloride, PEEK, a fluorocarbon (e.g., PTFE), a silicone rubber, a vinyl ester and combinations thereof. Typically, the device body is configured in a manner that allows a person to hold the device in such a way as to allow the combing of own or another person's hair in the combing direction, as is known in the art of hair styling devices.

In some embodiments, the total length (longest dimension) of a device is about 250 mm, and a width (in the combing direction) of about 75 mm and a thickness (perpendicular to the combing direction and length) of about 50 mm.

In some embodiments, the device body is configured for use only in one way, e.g., combing from a front of the device towards the back of the device in parallel to the combing direction. In some embodiments, the device body is configured for use only in two ways, e.g., combing from a front of the device towards the back of the device or from a back of the device towards the front of the device, in both cases in parallel to the combing direction.

In some embodiments, for such configuration, a device body includes a handle 62. In some embodiments, as in devices 10 and 32, the device body and/or a handle protrude beyond the styling surface.

Physical Association of Device Body With Styling Surface

As noted above, the styling surface is physically associated with the device body. Any suitable physical association may be used in implementing the teachings herein.

In some embodiments, such as device 32, the styling surface is immovably physically associated with the device body.

In some embodiments, especially embodiments particularly configured for combing hair such as device 10, the styling surface is movably fixed to the device body, allowing rotation of said styling surface relative to said device body around a rotation axis perpendicular to the styling surface (in the priority documents, also called "rotation" or "swivel"). In some embodiments, such rotation allows the styling surface to rotate relative to the arm and wrist of a user, helping to ensure that the combing paths and the geometry of interaction between the hair, especially a tangle and the combing teeth, is primarily dictated by the shape and arrangement of the combing teeth and not by an incidental manner in which a user is holding the device, thereby improving combing results and reducing tearing of hair.

According to an aspect of some embodiments of the teachings herein, there is also provided a device suitable for the styling of hair, comprising:

a) a device body;

b) physically associated with the device body, a backing component bearing a styling surface;

wherein the backing component is movably fixed to the device body, allowing rotation of the styling surface relative to the body around a rotation axis perpendicular to the styling surface.

In some such embodiments, the shape of the backing component when viewed perpendicularly to the rotation axis is circular. Such a circular shape prevents different portions of device of being exposed when the backing component and styling surface rotate relative to the device body.

In some embodiments, the rotation is 360° rotation around the rotation axis. In some embodiments, the device is configured so that the allowed rotation of the styling surface is in an arc of not more than 180°, not more than 120°, not more than 90°, not more than 60°, not more than 50°, not more than 40°, not more than 30° and even not more than 20° around the rotation axis.

In some embodiments, the device is configured so that the allowed rotation of the styling surface is in an arc of not less than 5°, not less than 15° and even not less than 30°.

As noted above, the physical association between the device body and the backing component allows rotation of the backing component relative to the device body as a result of application of an external force to the combing teeth, e.g., hair passing through the valleys between the combing teeth. Such a physical association allows the styling surface to rotate relative to the backing component to "align" the comb teeth with the hair and also to equalize the force applied to the hair in cases when a knot is encountered: instead of a large force applied to the knot while little force is applied to the rest of the hair which can lead to tearing of the hair, the styling surface rotates so that the force is applied to more hair, reducing the chance of tearing.

As the purpose of the physical association is to allow rotation of the backing component relative to the device body as a result of application of an external force to the combing teeth, the device is devoid of an internal drive to actively affect the rotation, e.g. an electric motor.

In some embodiments, such as in device 10, the device comprises a centering mechanism configured to apply a force to maintain the styling surface at a predetermined rest orientation relative to the device body.

According to an aspect of some embodiments of the teachings herein, there is also provided a device suitable for the styling of hair, comprising:

a) a device body;

b) physically associated with the device body, a backing component bearing a styling surface;

wherein the backing component is movably fixed to the device body, allowing rotation of the styling surface relative to the body around a rotation axis perpendicular to the styling surface; and further comprising a centering mechanism configured to apply a force to maintain the styling surface at a predetermined rest orientation relative to the body In some such embodiments, the device is configured to allow rotation of the styling surface in an arc of not more than ±30°, ±25°, ±20°, ±15° and even ±10° from the predetermined rest orientation. In some such embodiments, the device is configured to allow rotation of the styling surface of not less than ±5°, not less than ±10° and even not less than not less than 15°, In some embodiments, the centering mechanism comprises a leaf spring to generate at least some (and in some embodiments, all) of the force to maintain the styling surface at a predetermined rest orientation relative to the device body. In some embodiments, the leaf spring is a component of the backing component. In some embodiments; the leaf spring is integrally formed with the backing component. In some embodiments, the device comprises a handle and the leaf spring extends into the handle.

For example, device 10 is configured so that styling surface 14 is movably fixed to device body 12 in a manner that allows rotation of styling surface 14 relative to device body 12 around a rotation axis 60 perpendicular to styling surface 14. Device 10 also comprises a centering mechanism configured to apply a force to maintain styling surface 14 at a predetermined rest orientation where combing direction 30 is perpendicular to handle 62.

Details of the centering mechanism and the connection of backing component 18 with body component 20 of device 10 can be understood with reference to FIGS. 1H, 1I and 1J.

In FIG. 1H, backing component 18 that defines styling surface 14 and bears combing teeth 16 is seen from behind. Protruding from the back of backing component 18 are eight axially-flexible pegs 64 each with an inwardly-protruding catch 66 protruding from a peg shaft 68, pegs 64 arranged in a circle so as to constitute a circular socket 70 that is centered at the center of backing component 18. The diameter of the circle described by peg shafts 68 is 30 mm (as in FIG. 1J). The diameter of the circle described by catches 66 is 25 mm (b). The height from the surface of backing component 18 to catches 66 is 20 mm (c). The height from the surface of backing component 18 to the top of pegs 64 is 24 mm (d).

Extending proximally from a proximal end 72 of backing component 18 is an elastic leaf spring 74. In device 10, pegs 64 and leaf spring 74 are integrally formed by molding with backing component 18.

In FIG. 1I, body component 20 that mates to backing component 18 is depicted. Cylindrical axle 76 is seen protruding from the center of the inner surface of body component 20. The diameter of a proximal end 78 of cylindrical axle 76 is 29.5 mm (e, in FIG. 1J). 19 mm from proximal end 76 begins a 5 mm tall circular groove 80. The diameter of cylindrical axle 76 below circular groove 80 is 29.5 mm.

Two circular pegs 82 are seen protruding from the inner surface of the handle 62 portion of body component 20.

For assembly, socket 70 of backing component 18 is pressed against axle 76 of body component 20. Pegs 64 are bent outwards, catches 66 slip over proximal end 78 of axle 76, end then spring back into groove 80 as pegs 64 straighten. In such a manner, catches 66 engage groove 80, thereby movably fixing styling surface 14 to device body 10 and allowing rotation of styling surface 14 relative to device body 10 around a rotation axis 60 perpendicular to styling surface 14.

When backing component 18 and body component 20 are pressed together, care is taken that the distal end of leaf spring 74 is located between the two circular pegs 82. In such a manner, when styling surface 14 (and therefore backing component 18) is rotated relative to device body 12 (and therefore body component 20), leaf spring 74 is bent, thereby applying a force to maintain styling surface 14 at the predetermined rest orientation relative to device body 12, which is an orientation where combing direction 30 is perpendicular to handle 62.

Combing Teeth Material

The combing teeth are made of any suitable material. In some embodiments of devices that are particularly configured for combing, the combing teeth are made of a material having a thermal conductivity of not more than 2 W/(m K). In some embodiments, the combing teeth are made of a material selected from the group consisting of porcelain, glass, pyrex glass, an elastomer and a polymer.

As noted above, one feature that is advantageous for some embodiments of devices exceptionally suitable for combing hair is flexibility of combing teeth (which must not be so flexible as to render the teeth floppy), which is preferably implemented by one or more of the shape of the combing teeth and the material from which the combing teeth are made.

In some embodiments, the combing teeth are made of a material selected from the group consisting of an elastomer and polymer. In some such embodiments, the elastomer or polymer from which the combing teeth are made is a material having a shore hardness of not less than 60 and not more than 110. In some embodiments, the combing teeth are made of a material selected from the group consisting of ABS, polyester (e.g., Nylon), polycarbonate, polyethylene, polymethylmethacrylate, polypropylene, PEEK, polyurethane, polyvinylchloride, a fluorocarbon (e.g., PTFE), a silicone rubber, a vinyl ester and combinations thereof.

Device Suitable for Straightening Hair

As noted above, some embodiments of the device according to the teachings herein are suitable for straightening hair, specifically thermal straightening of the hair by transferring heat from the device to hair being combed.

Accordingly, in some embodiments (e.g., device 32), the device is configured to allow heating of at least one component selected from the group consisting of the combing teeth, the styling surface and both the combing teeth and the styling surface, thereby allowing use of the device for thermally induced straightening of hair when the combing teeth, styling surface or both are heated.

It has been found that such a device is surprisingly effective in straightening hair in a simple and intuitive manner by simply combing the hair in the usual way while the combing teeth, the styling surface or both are heated. Although not wishing to be held to any one theory, it is currently believed that as a hair strand passes through one of the multiple non-linear combing paths described above, stretching, bending and torquing forces are applied to the hair that straighten the hair, and the straightening is then at least partially set by the heat.

As is known to a person having ordinary skill in the art, use of known thermal hair straightening devices such as clamping irons leads to hair falling straight down in a distinctive way that has a certain charm but does not look natural. It has been found that use of some embodiments of a device according to the teachings herein allows for a more natural appearance where the straightened hair is not entirely straight but it is straightened. If straightening is performed quickly, that is to say, the device is combed through the hair at a relatively high speed, the hair is straightened to a lesser degree. If straightening is performed slowly, that is to say, the device is combed through the hair at a relatively low speed, the hair is straightened to a greater degree. It is currently believed that a combing rate of 1 cm/sec provides acceptable results for most hair. The exact speed used for straightening the hair of a specific person is dependent on the nature of the person's hair, the degree of straightening desired, and the temperature at which the components of the device are set.

Although there is a straightening effect when either only the styling surface or only the combing teeth are heated, it is currently believed that best results are obtained when both the combing teeth and the styling surface are heated. Without wishing to be held to any one theory, it is currently believed that heating of a given hair strand from three directions (styling surface and two combing teeth) and from a greater mass of material allows for more even and consistent heating. Further, as it is believed that at least part of the hair straightening occurs as a result of simultaneous heating and application of force to the hair, it is presumably important for the hair to be close to or in contact with a source of heat as much as possible, whether the combing tooth or the styling surface.

Material

In some such embodiments, the combing teeth, the styling surface or both are made of a heat-conducting material. In some such embodiments the combing teeth, the styling surface or both are made of a material having a thermal conductivity of not less than 10 W/(m K) at 300K, in some embodiments, about 90-130 W/(m K) at 300K. In some such embodiments the combing teeth, the styling surface or both are made of a material selected from the group consisting of a metal, a ceramic and combinations thereof (e.g., a titanium-ceramic blend). In some such embodiments the combing teeth, the styling surface or both comprise an outer coating which makes contact with hair when the device is used, the outer coating made of a material selected from the group consisting of metals, ceramics and combinations thereof. In some such embodiments, the metal is selected from the group consisting of aluminum, iron, copper, gold zinc, silver, tin, titanium, alloys thereof and combinations thereof. In some such embodiments, the ceramic is tourmaline.

In some preferred embodiments, the leading edge of the combing teeth is of a heat conducting material, that is to say, the leading edge of the combing teeth is devoid of an insulating layer or coating, or a separate insulating component. Specifically, at least some of the hair straightening effect according to the teachings herein is a result of the stretching, bending and torquing of hair at a leading edge of a combing tooth simultaneous with heat transfer to the hair from the leading edge.

In some preferred embodiments, the tops of the combing teeth are of a heat conducting material, that is to say, the tops of the combing teeth are devoid of an insulating layer or coating, or a separate insulating component.

In some embodiments, some or all of a combing tooth has a non-heat insulating coating, e.g., anodized, ceramic coating, PTFE (e.g., Teflon), nickel (e.g., electroless nickel). In some embodiments, such a coating is functional to reduce friction with the hair.

In some embodiments, the styling surface is of a thermally conductive material and the combing teeth are of a thermally insulating material and/or are thermally insulated from the styling surface. In some such embodiments, the device is configured for heating the styling surface to a high temperature (e.g., 200° C.) and the heat insulation and/or thermal conductivity of the combing teeth practically allows heating the combing teeth up to 40° C.

Combing Tooth Cross Section

As noted above, in some embodiments combing teeth 16 have a solid side cross section and in some embodiments combing teeth 16 have a hollow side cross section. In some embodiments of a device that is configured for straightening of hair, it is preferred that the combing teeth have a solid side cross section. It is believed that the greater mass of a combing tooth having a solid side cross section heats nearby hairs more effectively.

As noted above, in some embodiments in front cross section 50 combing teeth 16 are parallel-walled so that the sides of combing teeth 16 rise perpendicularly from the styling surface 14 and in other embodiments a front cross section 50 tapers from a widest portion at tooth base 26 to a narrower portion towards tooth tip 40. Apart from any advantages described, it is currently believed that for embodiments of a device that is particularly configured for straightening of hair, it is preferred that the combing teeth have a tapering front cross section 50. Although not wishing to be held to any one theory, it is currently believed that when hair is pressed into the downward tapering "valley" that is thereby formed between any two adjacent combing teeth, the "valley" having a narrowest portion close to styling surface 14, the hair is pressed down and straightened, increasing the straightening effect of the device.

Figure 11A:
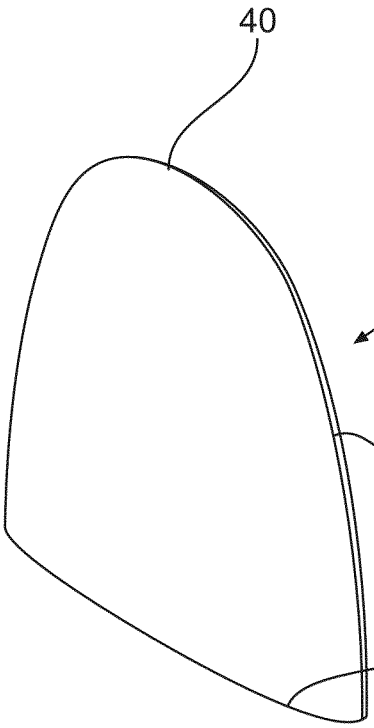
FIGS. 11A to 11D schematically depict an embodiment of a combing tooth for a device according to the teachings herein configured for straightening hair.
Figure 11B:
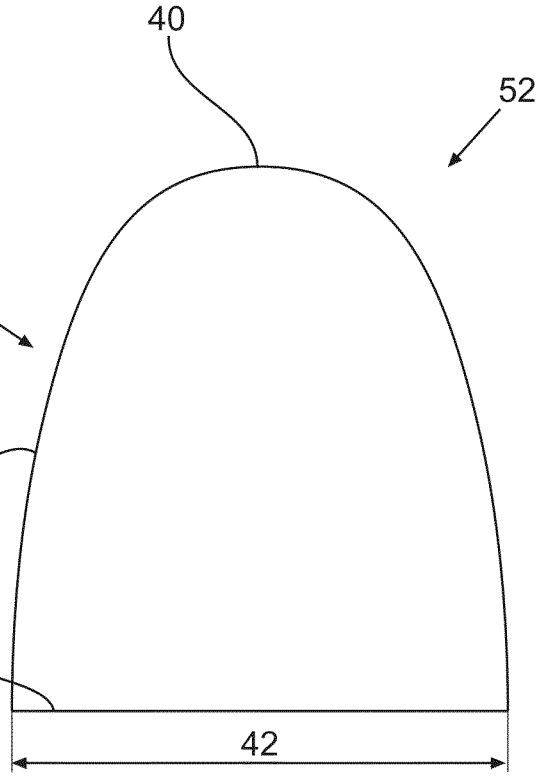
Figure 11D:
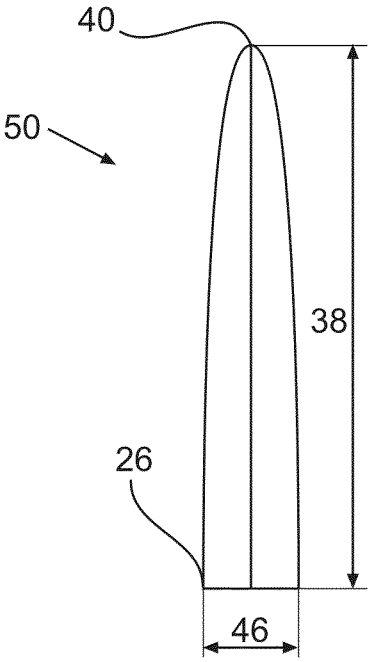
Figure 11C:
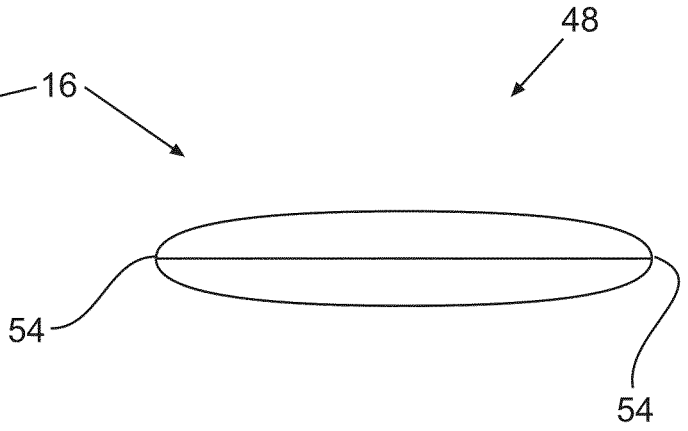

A combing tooth 16 having a shape exceptionally suited for use with a device configured for straightening hair is schematically depicted in FIG. 11: in FIG. 11A the combing tooth in isometric view; FIG. 11B in side view; FIG. 11C in top view; and FIG. 11D in front view. As seen in FIG. 11B, side cross section 52 of combing tooth 16 arches upwards from a longest portion at tooth base 26 to tip 40, where near the top sixth of combing tooth 16 side cross section 52 resembles a circular arch. As seen in FIG. 11C, top cross section 48 of combing tooth 16 is a flattened oval shape that continuously increases in width from a minimum at the two rounded leading edges 54 to a widest point at the center of top cross section 48. As seen in FIG. 11D, front cross section 50 of combing tooth 16 continuously tapers from a. widest portion at tooth base 26 to a narrower portion towards tooth tip 40.

Heating Assembly

In some embodiments, a device (such as device 32) according to the teachings herein that is suitable for straightening hair further comprises a controllable heating assembly for controlled heating of at least one component selected form the group consisting of the combing teeth and the styling surface.

In some embodiments, the device comprises a controllable heating assembly for controlled heating of both the combing teeth and the styling surface. In some such embodiments, a device comprises a single controllable heating assembly for controlled heating of both the combing teeth and the styling surface. In some such embodiments, the device comprises a controllable heating assembly for controlled heating of the combing teeth and a different controllable heating assembly for controlled heating of the styling surface.

In some embodiments, the controllable heating assembly is configured to allow optional heating of at least one component selected form the group consisting of the combing teeth and the styling surface to a maximum temperature. In some embodiments, the maximum temperature is not more than 250° C., not more than 230° C., and even not more than 210° C. In some embodiments, the maximum temperature is not less than 70° C., not less than 80° C. and even not less than 90° C. It is important to note that actual hair straightening is typically performed when components of the device are heated to a temperature that is between 80° C. and 220° C. and in some embodiments between 100° C. and 200° C.

In some embodiments, the device is configured to allow differential heating of the styling surface and of the comb teeth, For example, in some embodiments, the device is configured to allow heating or to heat the styling surface to a high temperature (e.g., between 80° C. and 220° C.) and the combing teeth to a lower temperature (e.g., between about 40° C. and 50° C.). In some such embodiments, this may be achieved by using a type of thermally conductive material for the styling surface, and a type of material that resists heat transfer (e.g., plastic/polymeric materials) for the manufacture of the combing teeth.

In some embodiments, the controllable heating assembly is configured to heat the component by thermal conduction as opposed to production of hot air, for example, the controllable heating assembly comprises resistive heaters in physical contact with the combing teeth and/or the component defining the styling surface.

Electrical power to heat a heating element is provided in any suitable manner. In some embodiments, electrical power is provided by an electrical cable connected to an external power source, e.g., mains electricity. In some embodiments, electrical power is provided by a component of the device, e.g., batteries.

Control Unit

In some embodiments, the device comprises a control unit functionally associated with a controllable heating element, the control unit functional to place a heating element in one of two states: OFF when a heating element is not heated and ON when a heating element is heated. Typically, the states are selected by allowing passage of sufficient electrical current to the heating element in the ON state and preventing passage of sufficient electrical current to the heating element in the OFF state. In some embodiments, the control unit is functionally associated with or comprises a sensor unit for measuring the temperature of the combing teeth, styling surface or both. Such a sensor unit is typically a thermostat or a component of a thermostat which is operative to assist in maintaining a desired temperature.

In some embodiments, a device includes a temperature indicator functionally associated with the control unit to indicate to a user that the device components are at a desired temperature. In some embodiments, such a temperature indicator is a LED light.

Temperature of Device Components for Straightening Hair

The Inventor has discovered that in some embodiments, there is a relationship between the temperature at which device components are heated and the efficiency of the hair straightening that in some instances depends on the type of hair. For example, in some embodiments, it is preferred that one or both of the combing teeth and styling surface are heated to a temperature of 80° C.-120° C. for thin hair (200-280 micrometer diameter), to a temperature of 120° C.-160° C. for normal hair (280-350 micrometer diameter) and to a temperature of 160° C.-220° C. for thick hair (350-500 micrometer diameter).

In some embodiments, the device is configured so that when in an ON state, the device components are heated to a pre-specified temperature. In some such embodiments, the specific device is configured to be operable only in one of the three above-referenced temperature ranges. Typically, such devices are also packaged and/or labeled and/or marketed for use for straightening a specific hair type. For example, in some embodiments:

a device is configured for heating one or both of the combing teeth and styling surface to some temperature in the range of 80° C.-120° C. (in some embodiments, a single temperature in the range, in some embodiments a sub range of the range, in some embodiments, the entire range), and is optionally additionally marketed and or packaged and/or labeled for use in straightening thin hair;

a different device is configured for heating one or both of the combing teeth and styling surface to some temperature in the range of 120° C.-160° C. (in some embodiments, a single temperature in the range, in some embodiments a sub range of the range, in some embodiments, the entire range), and is optionally additionally marketed and or packaged and/or labeled for use in straightening normal hair; and a different device is configured for heating one or both of the combing teeth and styling surface to some temperature in the range of 160° C.-220° C. (in some embodiments, a single temperature in the range, in some embodiments a sub range of the range, in some embodiments, the entire range), and is optionally additionally marketed and or packaged and/or labeled for use in straightening thick hair.

In some embodiments, the device comprises user controls that allow a user to select a temperature to which the control unit heats and maintains the heated device components. In some embodiments, selection is numerical, that is to say, a user enters a numerical value for the temperature. In some embodiments, selection is by hair type: there is a control (e.g., physical button, virtual button on a touch screen GUI) that allows selecting of one of at least one, in some embodiments one of at least two, and in some embodiments one of all three of the heating states:

a thin hair state which leads to heating one or both of the combing teeth and styling surface to some temperature in the range of 80° C.-120° C. (in some embodiments, a single temperature in the range, in some embodiments a sub range of the range, in some embodiments, the entire range);

a normal hair state which leads to heating one or both of the combing teeth and styling surface to some temperature in the range of 120° C.-160° C. (in some embodiments, a single temperature in the range, in some embodiments a sub range of the range, in some embodiments, the entire range); and a thick hair state which leads to heating one or both of the combing teeth and styling surface to some temperature in the range of 160° C.-220° C. (in some embodiments, a single temperature in the range, in some embodiments a sub range of the range, in some embodiments. the entire range).

In some embodiments, the device comprises a sensor unit operable to determine a type of hair (thick, normal, thin). In some such embodiments, the control unit is configured to automatically select a temperature to which components of the device are heated, as discussed above. In some embodiments, such a sensor unit comprises an imager sensor (e.g., CCD device) configured for and operable to acquire one or more images of hair being combed by a device and transfer such images to a control unit for analysis of properties of the hair. In some embodiments, such analysis includes one or more of edge detection, optical refraction and transmission properties of the hair.

Device 32 depicted in FIG. 2 is configured for straightening hair. Styling surface 14 and combing teeth 16 are parts of backing component 18, a single monolithic block of cast aluminum, a heat conducting material. As a result, device 32 is configured to allow heating of both combing teeth 16 and styling surface 14.

In FIG. 2B, device 32 is depicted in an exploded view showing the various components including: back body component 84, insulator 86, heat sink 88 of aluminum, leaf spring 90, resistive heater 92, control unit 94, backing component 18, electrical cable holder 96, front body component 98 and spring-loaded buttons 100, Not depicted is an electrical cable that is functionally associated with control unit 94 through electrical cable holder 96.

When the various components are assembled and held together by screws, leaf spring 90 ensures that the components are pressed together and do not move. When the electrical cable is plugged into a wall socket, a user activates control unit 94 through buttons 100, typically turning device 32 on and off, and setting the desired temperature of backing component 18. Once turned on, control unit 94 intermittently directs electrical current to resisitive heater 92 with reference to an integrated thermometer, thereby producing heat to heat sink 88 and backing component 18 to bring styling surface 14 and combing teeth 16 to the desired set temperature.

Guide Teeth and Other Teeth

As noted above, a device according to the teachings herein comprises a plurality of at least ten combing teeth distributed on the styling surface, each such tooth fixedly attached to the styling surface through a respective tooth base so as to protrude perpendicularly from the styling surface, each such tooth having: i. along a height axis perpendicular to the styling surface, a height measured from the base of the tooth at the styling surface to a respective tooth tip, ii. along a length axis of the tooth on the styling surface, a length, iii. along a width axis on the styling surface and perpendicular to the length axis, a width, the width being less than the length, iv. a top cross section in a plane including the width axis and the length axis, v. a front cross section in a plane including the width axis and the height axis, and vi. a side cross section in a plane including the length axis and the height axis; wherein the length axes of the combing teeth of the plurality of teeth are parallel and define a combing direction of the styling surface.

It is important to note that in some embodiments, a device according to the teachings herein has additional teeth, including teeth which function for combing hair and/or including teeth that are fixedly attached to the styling surface.

For example, in some embodiments, a device according to the teachings herein further comprises guide teeth (some embodiments of which are referred to as "slender hair brushing elements" in the priority documents), the guide teeth having a height and attached to the device so as to protrude beyond the tips of the combing teeth, wherein the guide teeth are located along a peripheral edge of the styling surface. It has been found that some embodiments of such guide teeth provide an advantageous effect of more easily penetrating the hair to be combed, separating into locks, and assisting in distributing the locks and individual hairs into different combing paths. Both device 10 and device 32 comprise guide teeth 102.

In some embodiments, the guide teeth are made of the same material as the combing teeth, for example device 10.

In some embodiments, the guide teeth are made of a material different from which the combing teeth are made. For example, in some embodiments of devices configured for straightening hair such as device 32, guide teeth 102 are made of a non-thermally conducting material, so that the guide teeth 102 act as a heat shield reducing the chance of contact of the scalp or other portion of a person's body with heated parts of the device, for example, heated combing teeth 16. For example, in some such embodiments, the guide teeth are made of a material having a thermal conductivity of not more than 2 W/(m K) at 300K, in some embodiments about 0.2 to 3, or 0.2 to 0.9 2 W/(m K).

The guide teeth have any suitable height. In some embodiments, the tips of the guide teeth protrude beyond the tips of the highest combing teeth by not more than 2 mm, not more than 1.5 mm and in some embodiments, not more than 1 mm. In some embodiments, the guide teeth have a height of not more than 18 mm, and in some embodiments, of not more than 19 mm. In some embodiments, all guide teeth are of the same height.

The guide teeth have any suitable length. In some embodiments, the guide teeth have a length less than that of the combing teeth. In some embodiments, the guide teeth have a length of between 5.5 mm and 6.5 mm (i.e., about 6 mm).

In some embodiments, the guide teeth have a side cross section with a shape selected from the group consisting of elongated semi-elliptical, circular, polygonal and parabolic-like.

In some embodiments, the guide teeth are located along at least two peripheral edges of the styling surface.

In some embodiments, the guide teeth are located around substantially the entire periphery of the styling surface, e.g., devices 10 and 32, that substantially loops around the styling surface 14.

In some embodiments, the guide teeth are attached to at least one of the device body and the styling surface. For example, in device 10, guide teeth 102 are attached to styling surface 14 while in device 32, guide teeth 102 are attached to device body 12.

In some embodiments, in side cross section, the guide teeth have a convexly curved side facing away from the center line of the styling surface. In some embodiments, in side cross section, the guide teeth are half arches having a convexly curved side facing away from the center line of the styling surface, e.g., guide teeth 102 of device 32.

In some embodiments, the guide teeth have a width similar to that of the combing teeth, within the ranges as described above. In some such embodiments, the guide teeth are 2.5 mm wide.

In some embodiments, the guide teeth are thinner that the combing teeth. In some embodiments, the guide teeth are between 0.5 mm and 0.9 mm wide.

Scalp Guard

A danger when using a device configured for straightening hair is that contact of the scalp with the tips of heated combing teeth can potentially lead to burns.

Accordingly, in some embodiments the device further comprises a scalp guard attached to the device so as to be located above the styling surface, the scalp guard configured to prevent physical contact of a scalp with heated combing teeth during use of the device.

In some embodiments, the scalp guard is attached to at least one of the device body and the styling surface. In device 32, scalp guard 104 is a component of front body component 98 and is therefore attached to the device body.

In some embodiments, the scalp guard is irreversibly attached above the styling surface.

In some embodiments, the scalp guard is reversibly attached above the styling surface, allowing simple removal for cleaning of combing teeth.

In some embodiments, the scalp guard is rigid.

In some embodiments, the scalp guard comprises one or more bars oriented in parallel to the combing direction.

In some embodiments, the device comprises guard teeth and the scalp guard comprises one or more bars, the bars connected to the guard teeth to extend over the styling surface so as to be oriented in parallel to the combing direction. In some embodiments, such as in device 32, the scalp guard bars 104 connect between two guard teeth 102 that are located along opposing peripheral edges of the device.

According to an aspect of some embodiments of the teachings herein, there is also provided a device suitable for use in the styling of hair, the device comprising:

a) a device body;

b) physically associated with the device body, a styling surface having at least one peripheral edge;

c) a plurality of combing teeth distributed on the styling surface, each such combing tooth fixedly attached to the styling surface;

wherein the device is configured to allow heating of the combing teeth thereby allowing use of the device for thermally induced straightening of hair;

wherein the combing teeth are made of a heat-conducting material;

further comprising guide teeth made of a heat-insulating material having a thermal conductivity of not more than 2 W/(m K), the guide teeth having a height and attached to the device so as to protrude beyond the tips of the combing teeth, wherein the guide teeth are located along a periphery of the styling surface;

further comprising a rigid scalp guard attached to the device so as to be located above the styling surface, the scalp guard and guide teeth configured to prevent physical contact of a scalp with heated combing teeth during use of the device; and the scalp guard comprising one or more bars oriented in parallel to the combing direction. In some embodiments, each bar of the scalp bar is connected to the two guard teeth located along opposing sides of the styling surface to thereby extend over the styling surface and to be oriented in parallel to the combing direction.

Polishing

In some embodiments, a device according to the teachings herein further comprises inorganic particles physically associated with an outer surface of the combing tooth, so that the combing teeth are thereby configured for polishing hair. While hair is combed with such a device, the inorganic particles polish and smooth the outer surface of the hair, providing a desired sheen. It is currently believed that in some embodiments, the fact that the length of the combing teeth is greater than the width provides a greater surface area over which the hairs interact with the inorganic particles, increasing the polishing effect. It is also currently believed that in some embodiments, multiple non-linear combing paths increase the force with which hairs contact the surface of the combing teeth during combing, thereby increasing the polishing effect. It is also believed that in some embodiments, the particular shape of the combing tooth (particularly of the top cross section) increases contact of hairs with the polishing surface, thereby increasing the polishing effect.

According to an aspect of some embodiments of the teachings herein, there is also provided a device suitable for use in the styling of hair, the device comprising: a) a device body; and b) at least ten teeth suitable for combing hair, and further comprising inorganic particles physically associated with an outer surface of the combing teeth, so that said combing teeth are thereby configured for polishing hair. In some embodiments, the device comprises:

a) a device body;

b) physically associated with said device body, a styling surface having at least one peripheral edge; and c) a plurality of at least ten combing teeth distributed on said styling surface, each tooth fixedly attached to said styling surface through a respective tooth base so as to protrude perpendicularly from said styling surface, each said tooth having:

i. along a height axis perpendicular to said styling surface, a height measured from said base of said tooth at said styling surface to a respective tooth tip, ii. along a length axis of said tooth on said styling surface, a length, iii. along a width axis on said styling surface and perpendicular to said length axis, a width, said width being less than said length, iv. a top cross section in a plane including said width axis and said length axis, v. a front cross section in a plane including said width axis and said height axis, and vi. a side cross section in a plane including said length axis and said height axis;

wherein said length axes of said combing teeth of said plurality of teeth are parallel and define a combing direction of said styling surface.

The inorganic particles are any suitable inorganic particles including ceramics, sapphire, carborundum and diamond. In some embodiments, diamond particles are advantageous as these provide an anti-static effect in addition to a polishing effect.

The inorganic particles are of any suitable size. In some embodiments, the inorganic particles have an average particle size of not less than 10 micrometers and not more than 40 micrometers.

The inorganic particles are physically associated with an outer surface of the combing teeth in any suitable manner. In some embodiments, the particles are physically associated with the surface of the combing teeth with the use of adhesive. In some embodiments, the combing teeth have a hollow side cross section, and the adhesive encircles a portion of the combing teeth to improve the physically association of the particles with the combing tooth.

Variant combing tooth 16 depicted in FIG. 1D' has diamond dust 106 physically associated with the outer surface thereof with the use of an adhesive that encircles a portion of combing tooth 16 through hollow 58

Exchangeable Styling Surface and Combing Teeth

In some embodiments, the styling surface and combing teeth are a portion of a component separate from the device body, e.g., in the form of an exchangeable/wearable (e.g., elastic) sleeve having the combing teeth mounted thereupon. Such an exchangeable sleeve may be adapted to fit over a suitable support structure (e.g., substantially flat, curved, rotatable or stationary circular) that constitutes the device body, thereby providing a hair treatment device with exchangeable styling surfaces having different arrangements of combing teeth. In some such embodiments, a hair styling kit is provided having one or more various support structures having different geometrical shapes (with or without heating units) and one or more exchangeable sleeves constituting a set, each sleeve bearing a different arrangement of combing teeth.

ADDITIONAL EMBODIMENTS

Additional embodiments of a device according to the teachings herein are depicted in FIGS. 3 to 10.

Figure 3A:
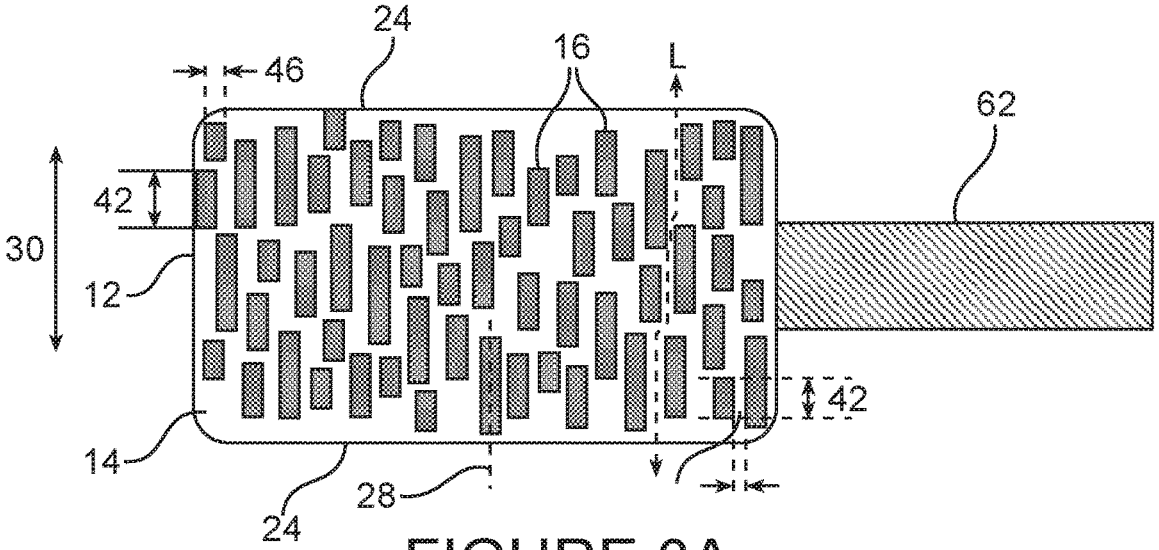
FIGS. 3A to 3C schematically depict embodiments of devices according to the teachings herein from a front view.
Figure 3B:
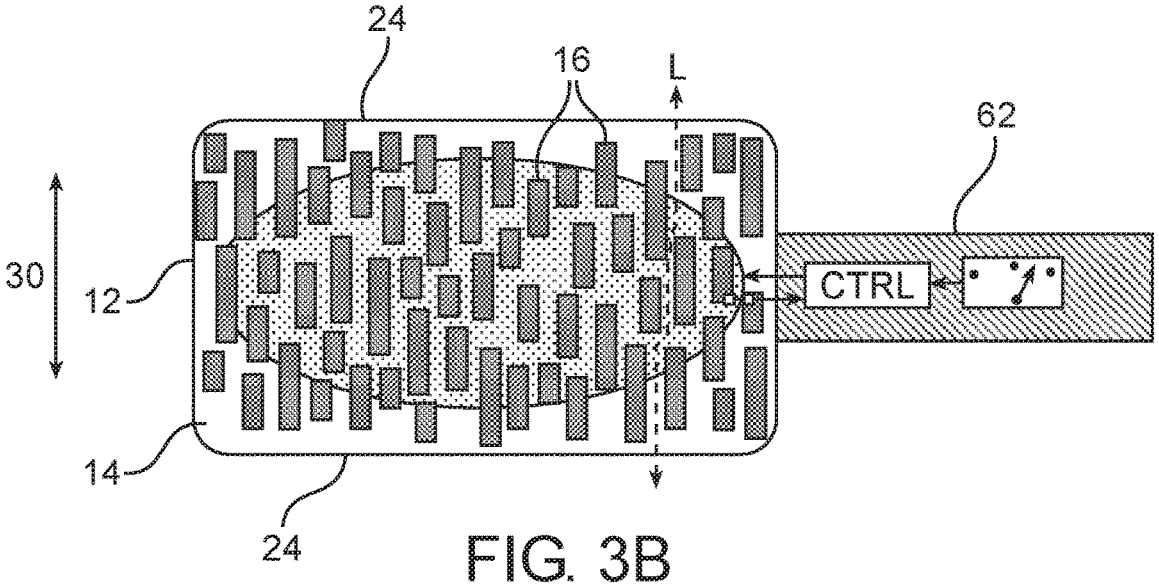
Figure 3C:
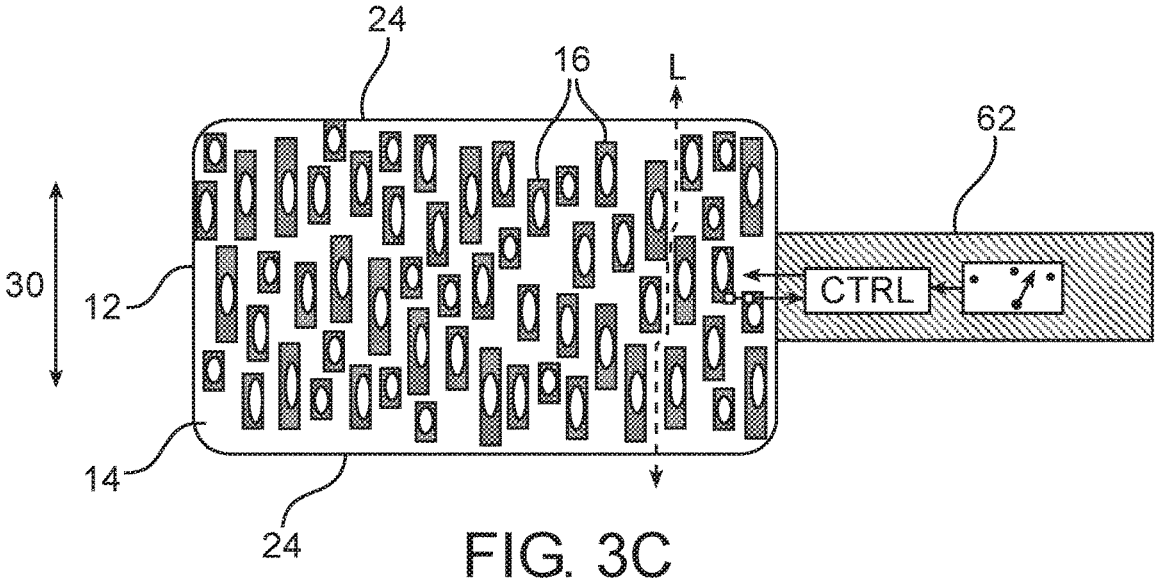
Figure 4A:
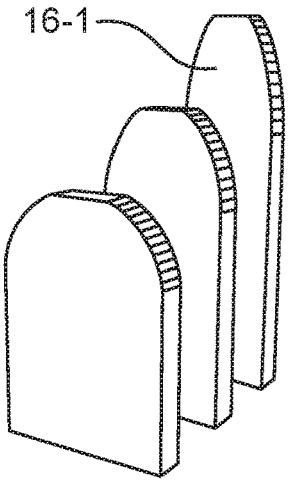
FIGS. 4A to 4H schematically depict embodiments of combing teeth according to the teachings herein in isometric view.
Figure 4B:
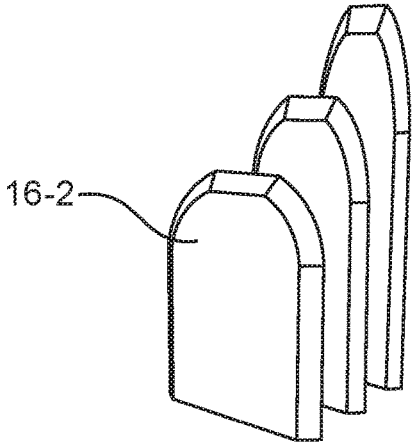
Figure 4C:
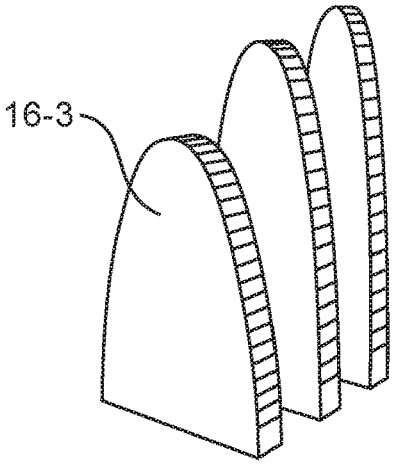
Figure 4D:
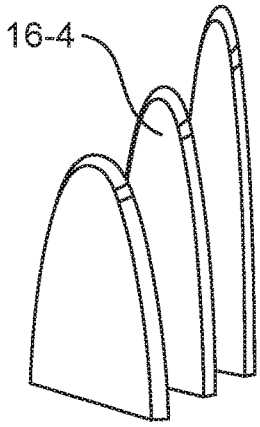
Figure 4E:
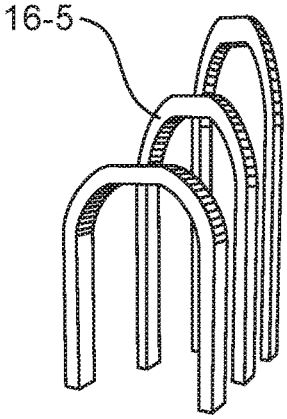
Figure 4F:
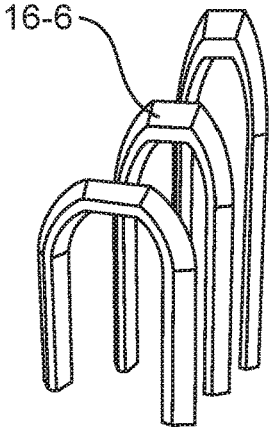
Figure 4G:
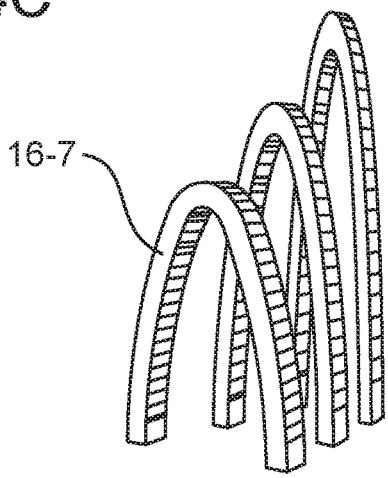
Figure 4H:
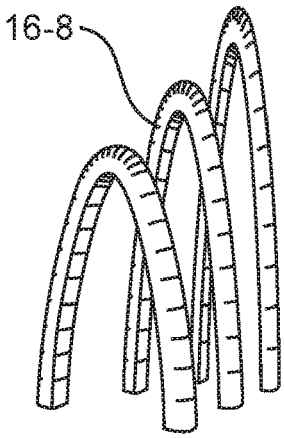

FIGS. 3A to 3C schematically depict embodiments of devices according to the teachings herein from a front view. An exemplary non-linear combing path is indicated by the dotted line labeled L.

FIGS. 4A to 4H schematically depict embodiments of combing teeth indicated with the reference numeral 16-*x* (x from 1 to 8) according to the teachings herein in isometric view. It is seen that the different combing teeth have different height, width and length cross sections, as well as different heights, widths and lengths.

Figure 5B:
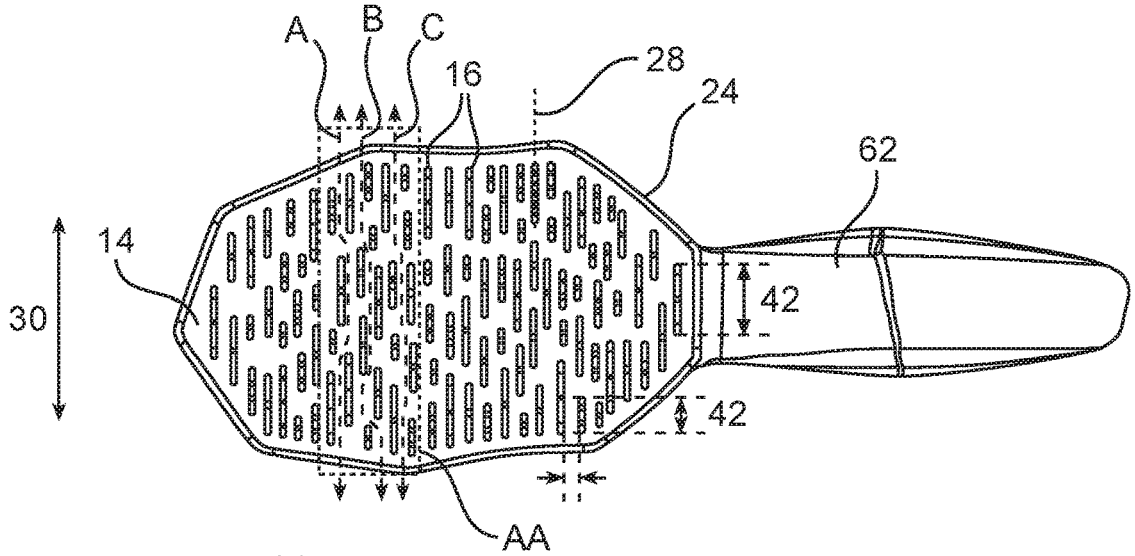
FIGS. 5A to 5C schematically depict an embodiment of a device according to the teaching herein in side view (5A), front view (5B) and detailed front view (5C)
Figure 5A:
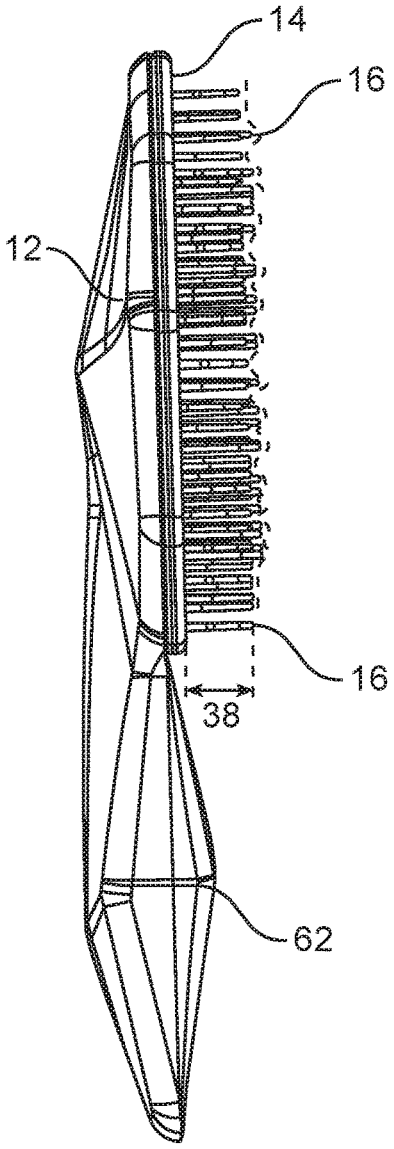
Figure 5C:
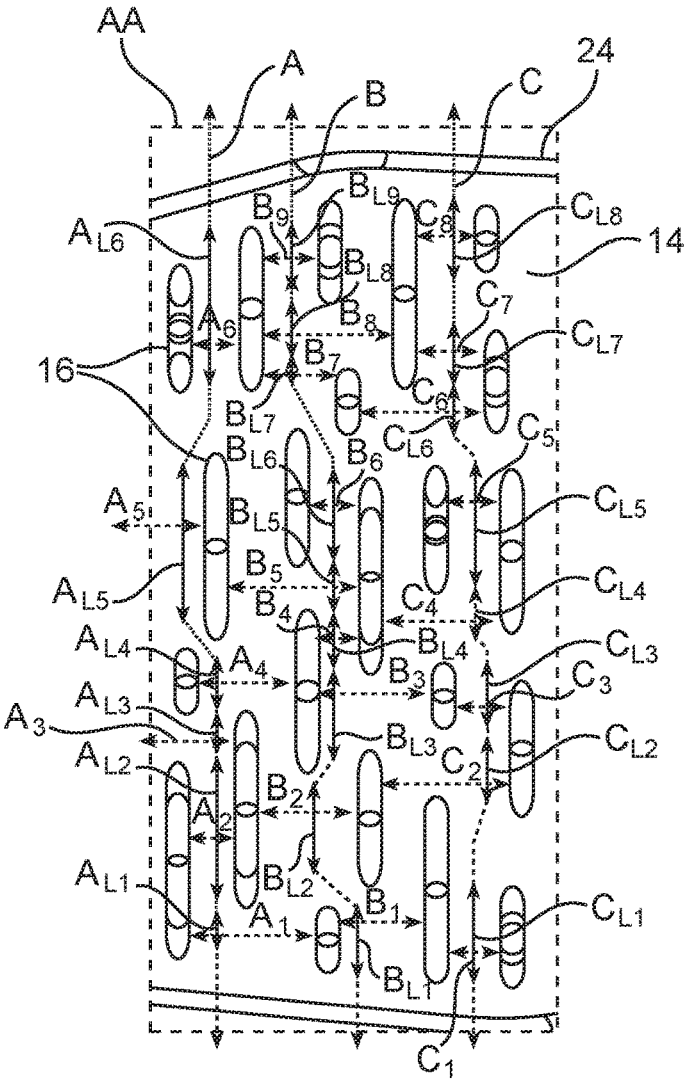

FIGS. 5A to 5C schematically depict an embodiment of a device according to the teaching herein in side view (5A), front view (5B) and detailed front view (5C). Exemplary non-linear combing paths are indicated by the dotted lines labeled A, B, C and the constituent linear portions are indicated with A, B, C and an accompanying subscript.

Figure 6A:
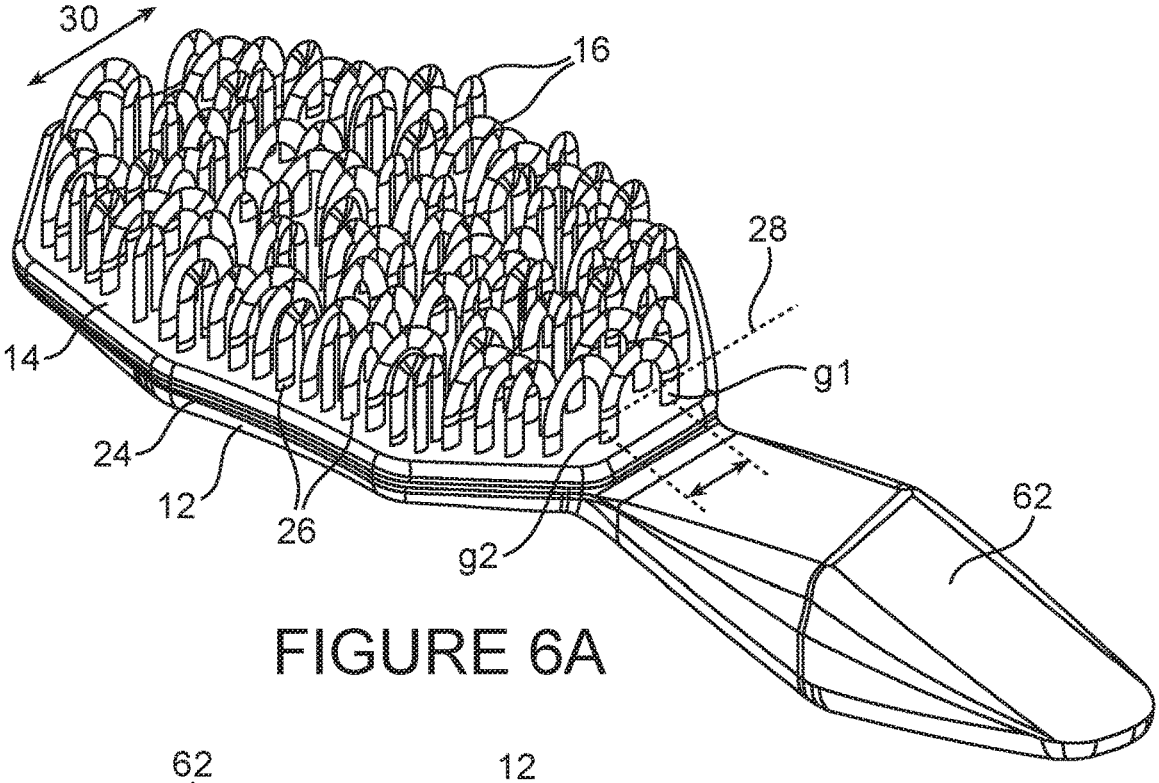
FIGS. 6A to 6C schematically depict an embodiment of a device according to the teaching herein in isometric view (6A), top end view (6B) and end view from the handle (6C)
Figure 6B:
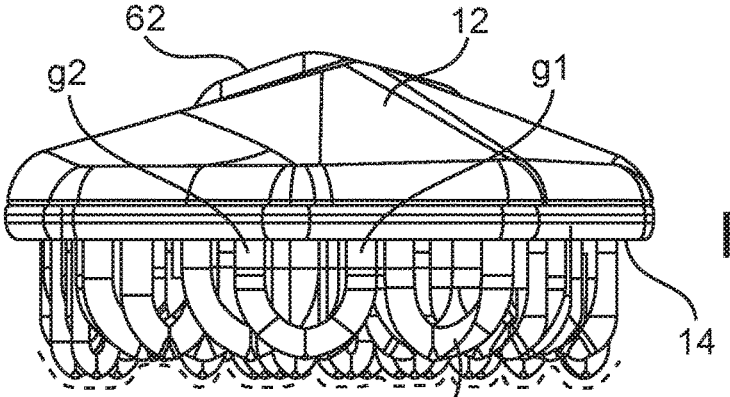
Figure 6C:
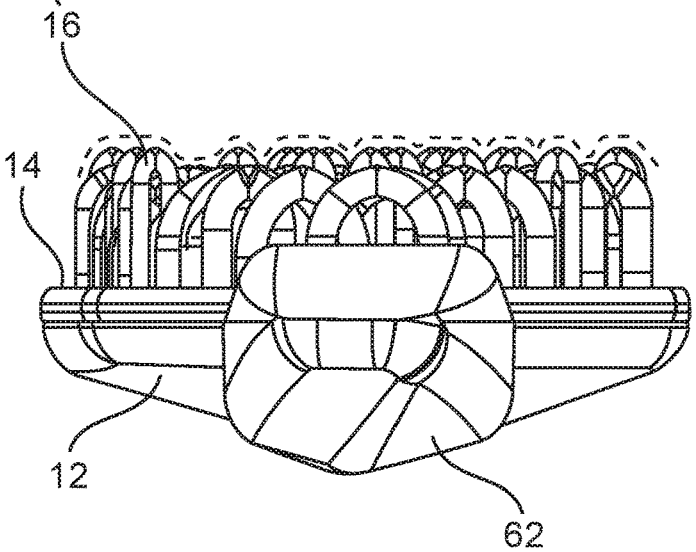

FIGS. 6A to 6C schematically depict an embodiment of a device according to the teaching herein in isometric view (6A), top end view (6B) and end view from the handle (6C).

Figure 7A:
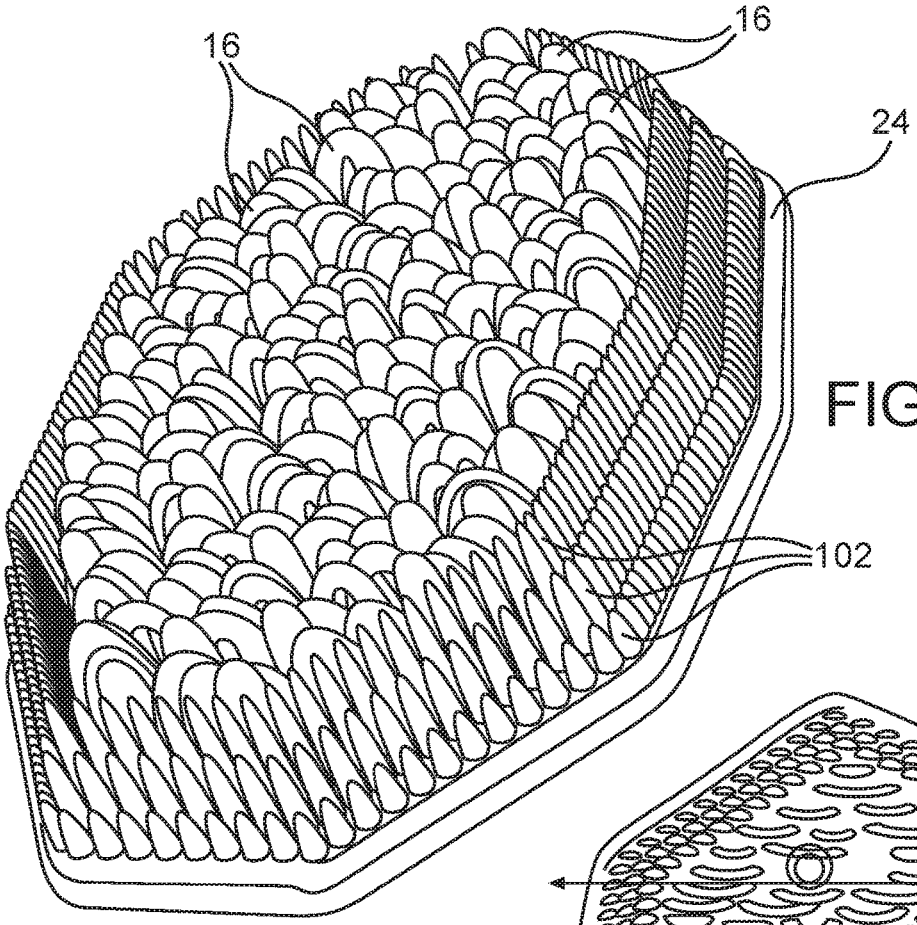
FIGS. 7A to 7B schematically depict an embodiment of a hacking component bearing a styling surface and combing teeth of a device according to the teaching herein in isometric view (7A), and front view (7B)
Figure 7B:
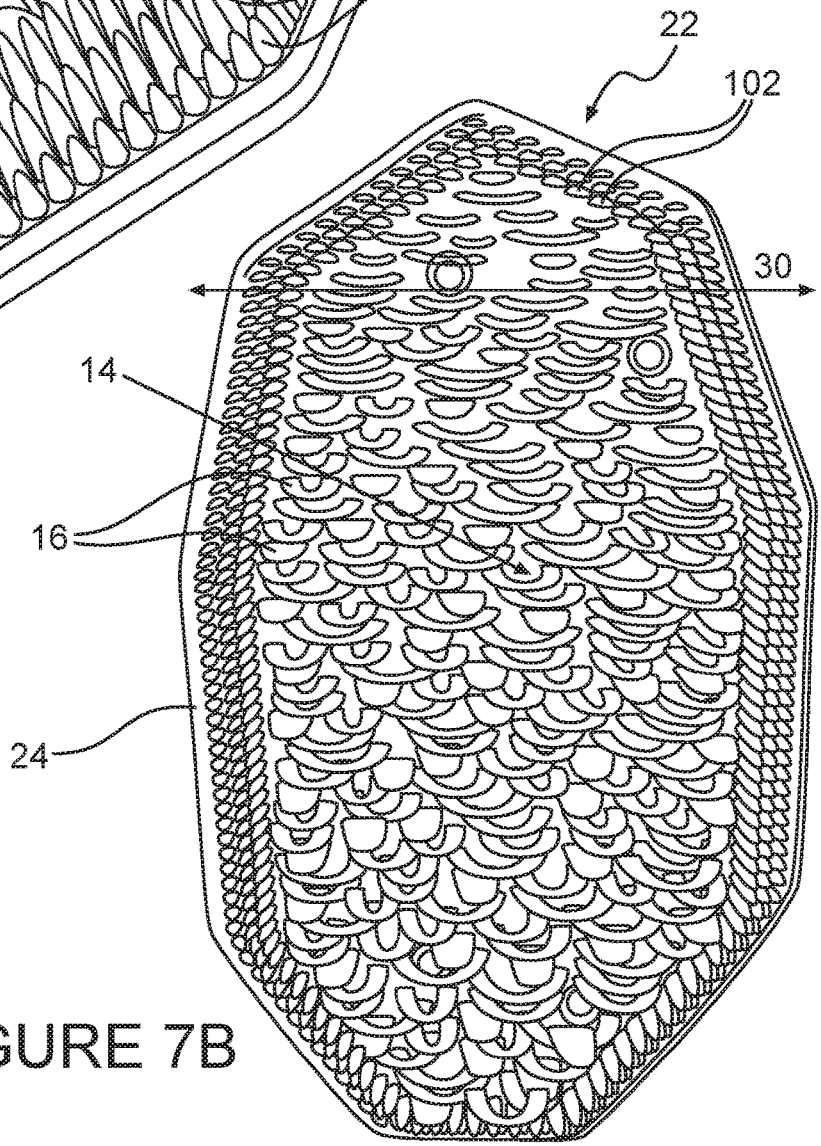
Figure 8A:
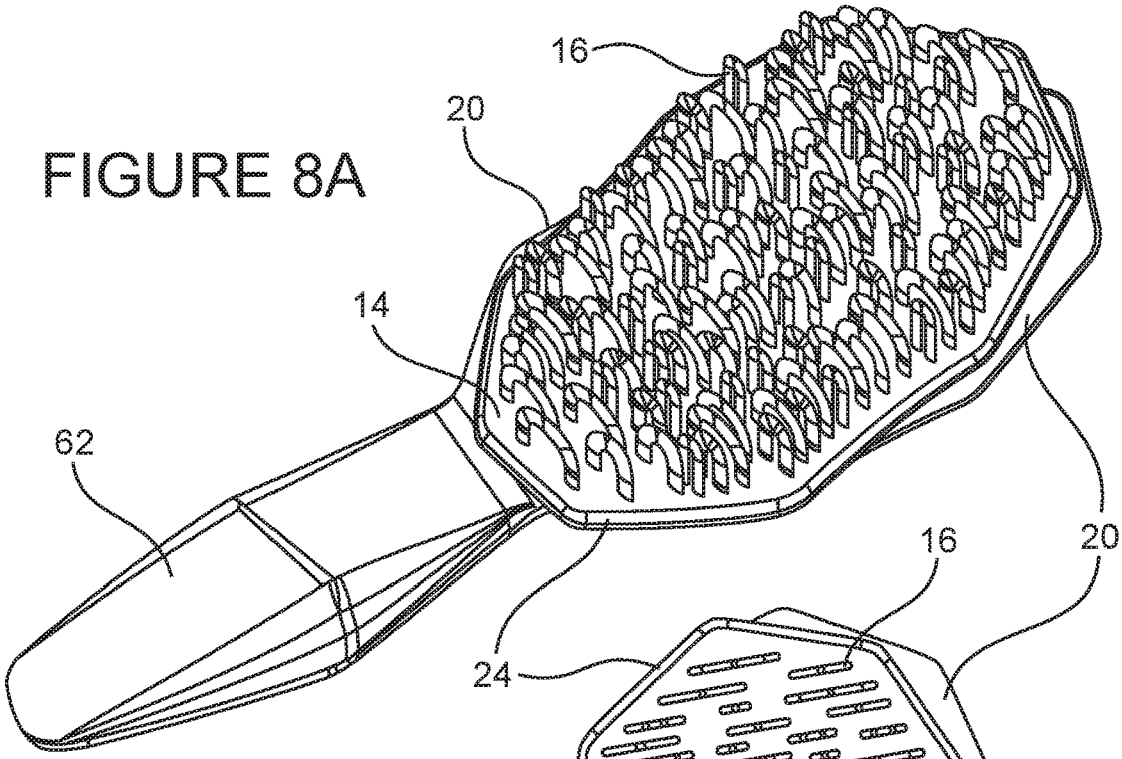
FIGS. 8A to 8E schematically depict an embodiment of a device according to the teachings herein in isometric view (8A), front view (8B), exploded top end view (8C), exploded isometric view (8D) and exploded side view (8E)
Figure 8B:
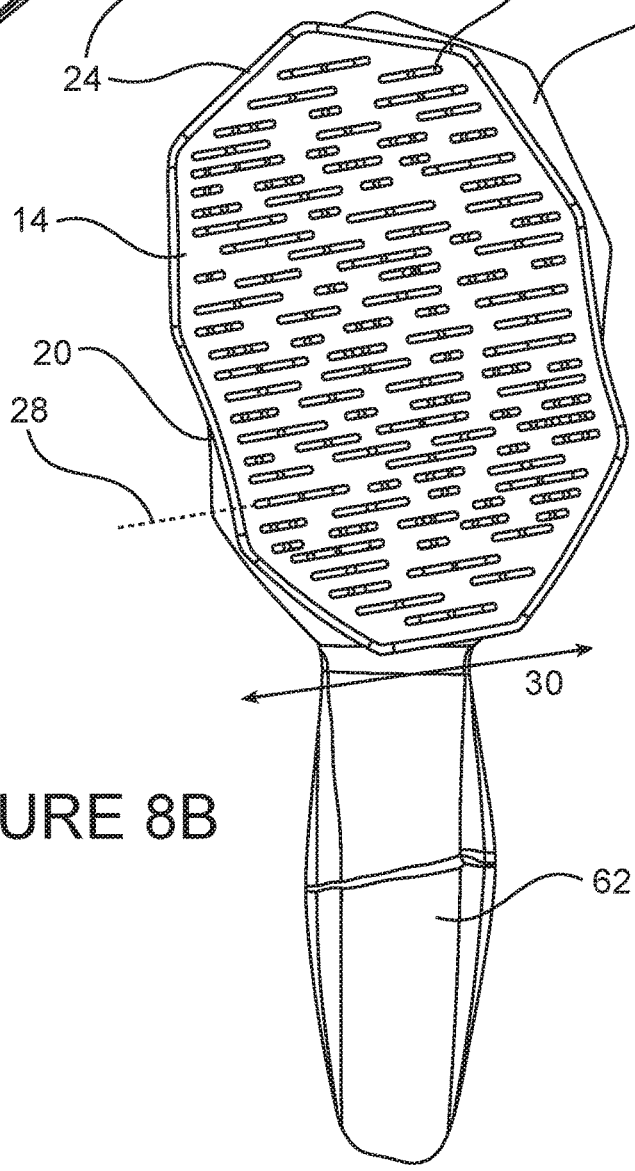
Figure 8C:
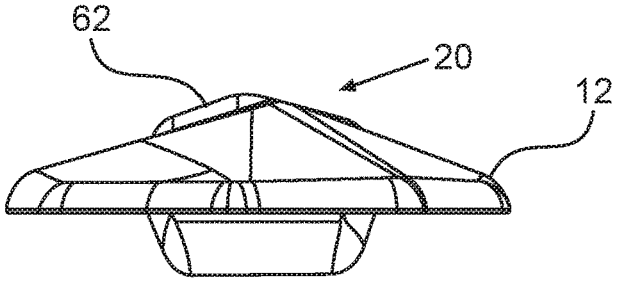
Figure 8C:
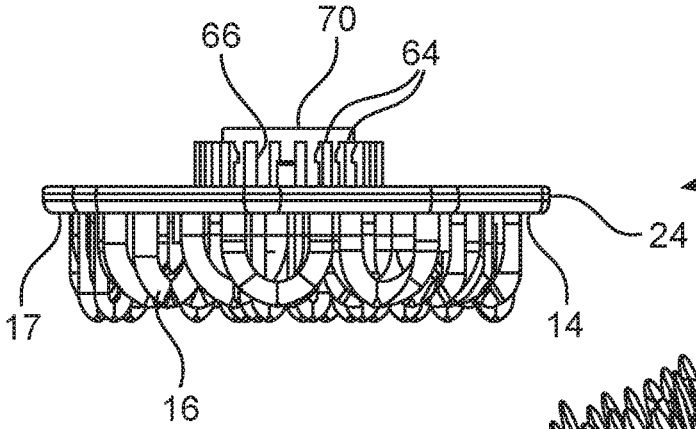
Figure 8D:
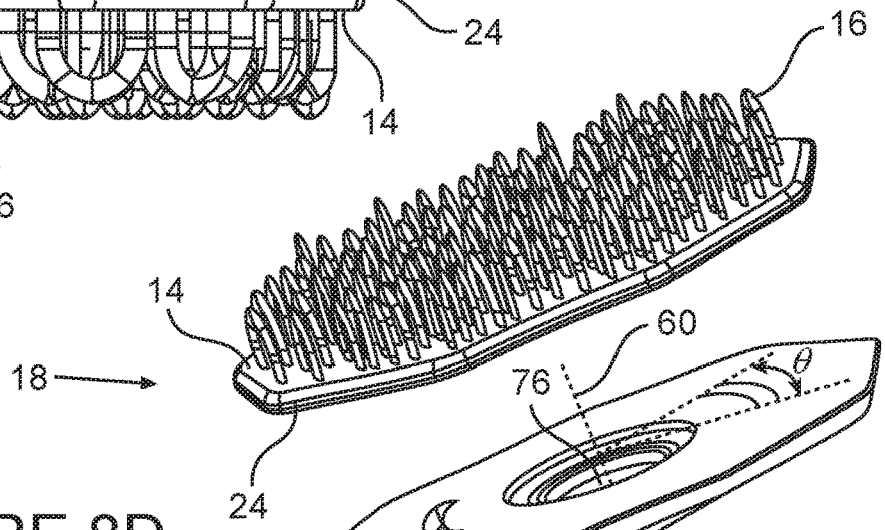
Figure 8E:
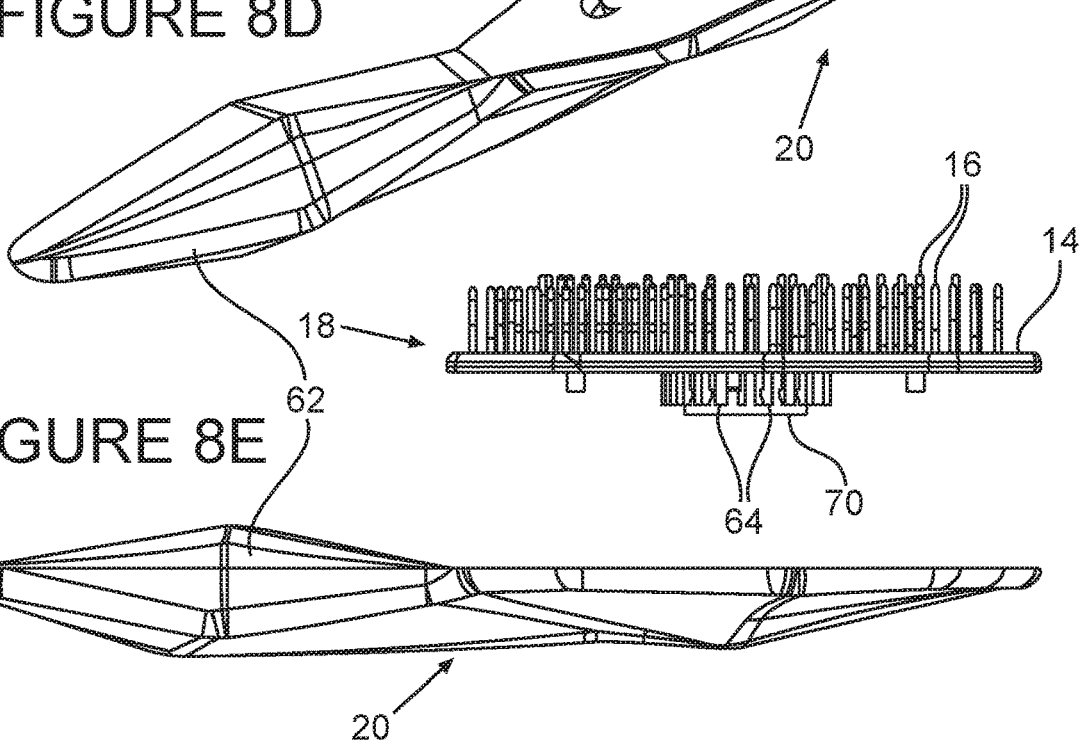

FIGS. 7A to 7B schematically depict an embodiment of a backing component bearing a styling surface and combing teeth of a device according to the teaching herein in isometric view (7A), and front view (7B), FIGS. 8A to 8E schematically depict an embodiment of a device according to the teachings herein in isometric view (8A), front view (8B), exploded top end view (8C), exploded isometric view (8D) and exploded side view (8E). The exploded views in FIGS. 8C, 8D and 8D provide details of the implementation of rotation of the styling surface relative to the device body.

Figure 9A:
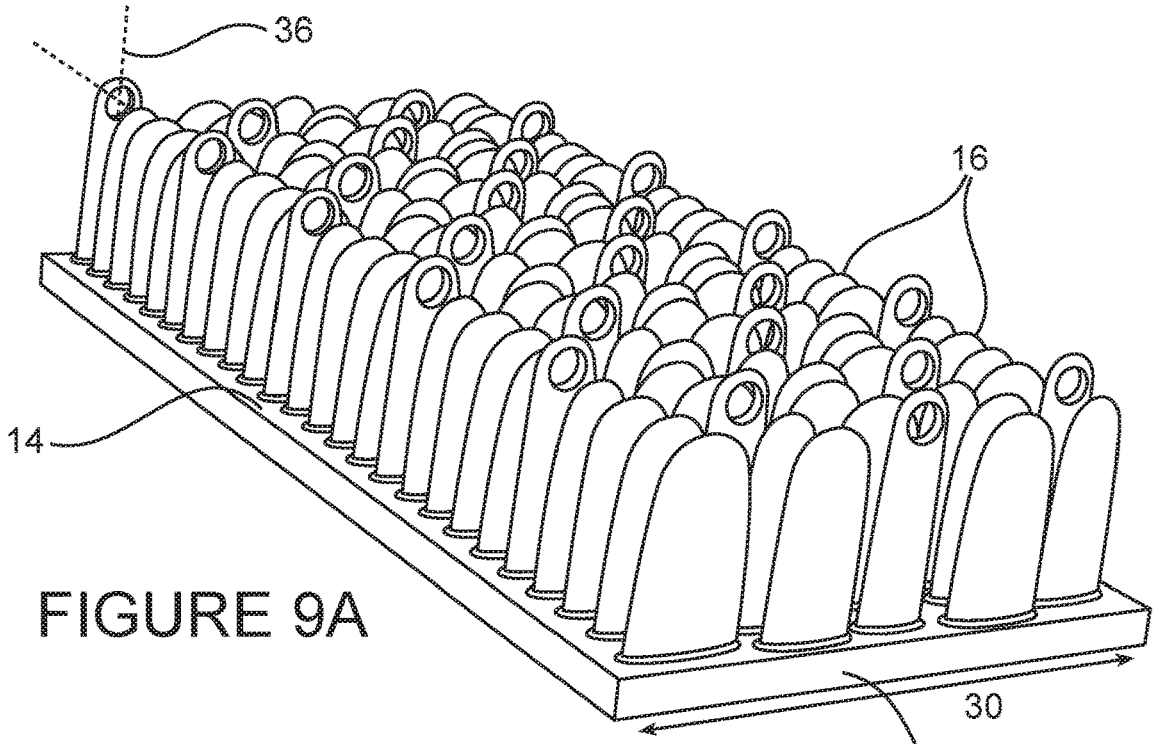
FIGS. 9A to 9B schematically depict an embodiment of a backing component with styling surface and combing teeth of a device according to the teaching herein in isometric view (9A) from the top, and isometric view from the back (9B)
Figure 9B:
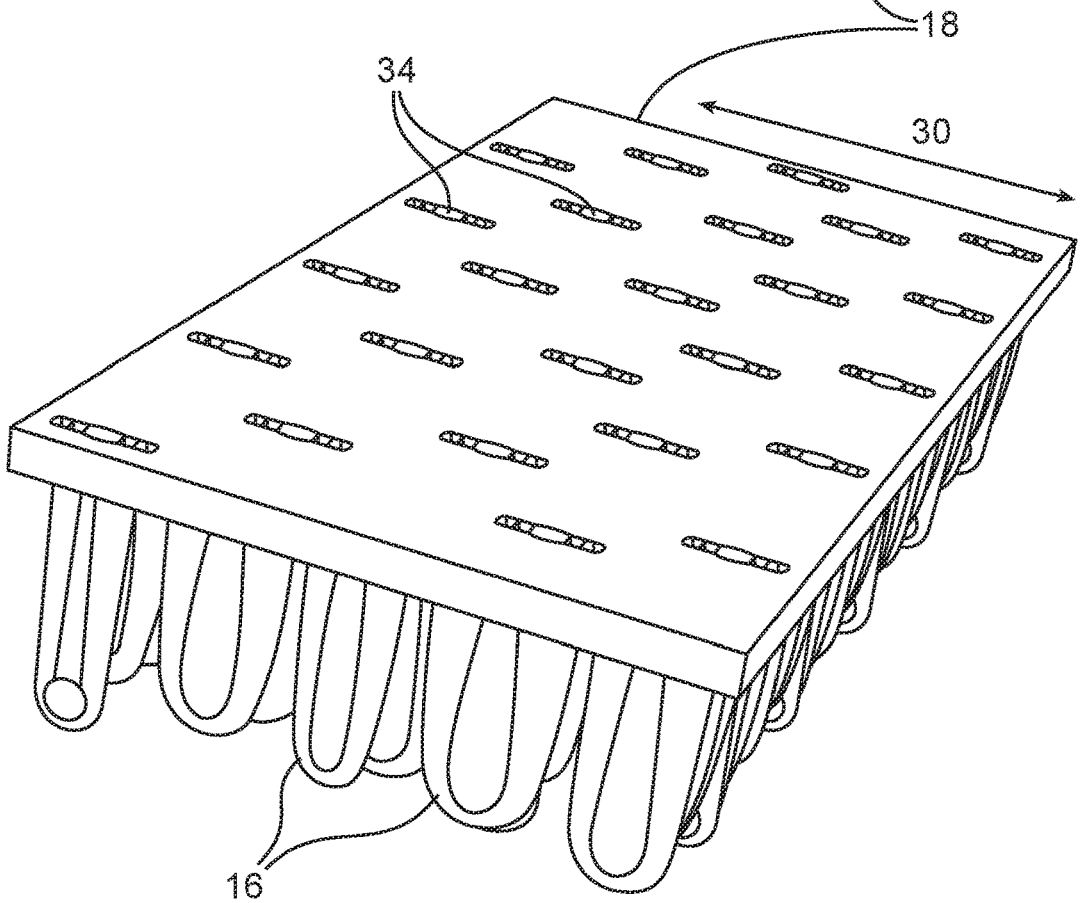
Figure 10A:
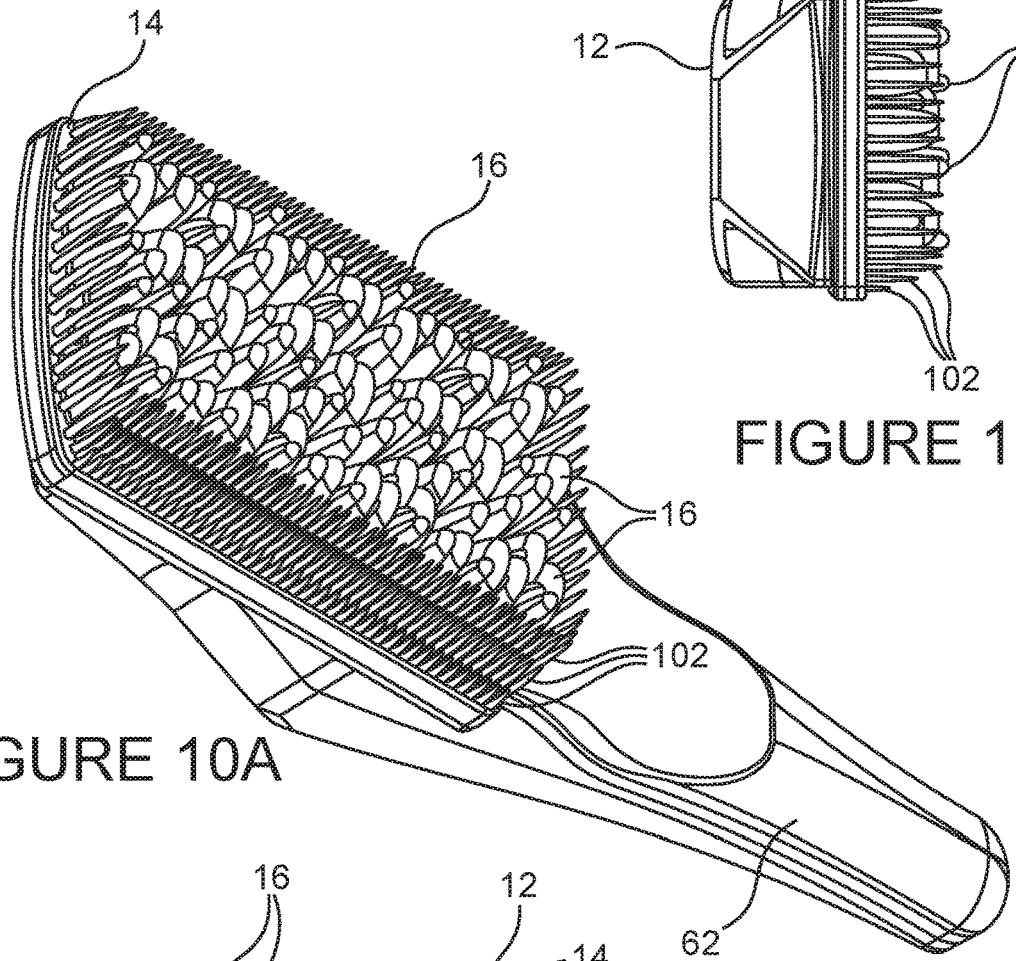
FIGS. 10A to 10D schematically depict an embodiment of a device according to the teachings herein in isometric view (10A), top end view (10B), front view (10C) and side view (10D)
Figure 10B:
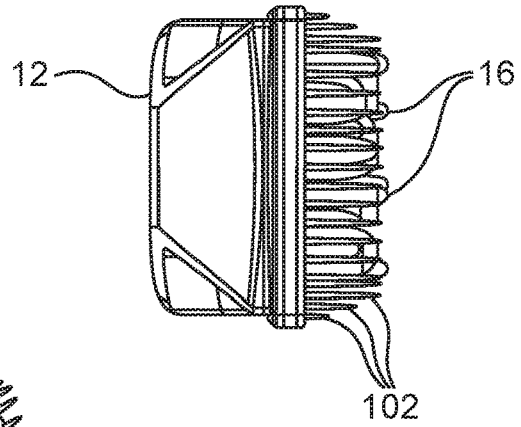
Figure 10C:
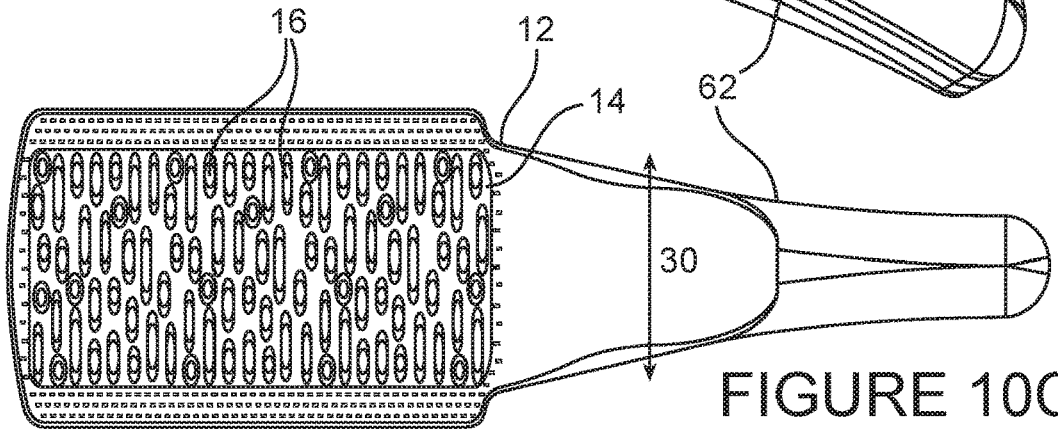
Figure 10D:
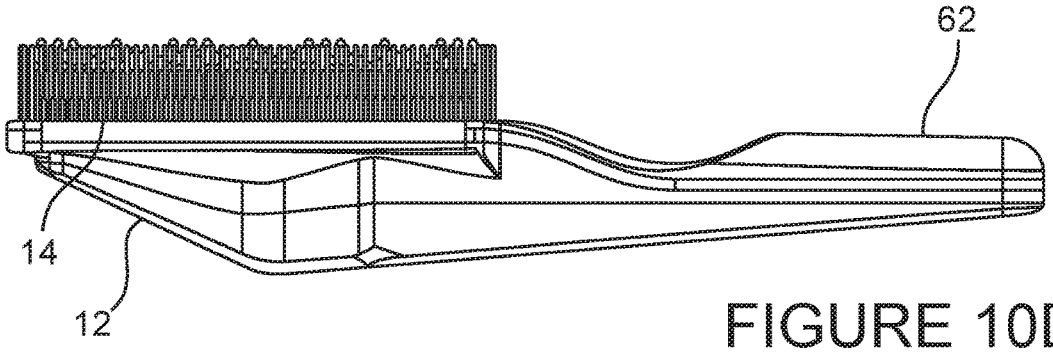

FIGS. 9A to 9B schematically depict an embodiment of a backing component with styling surface and combing teeth of a device according to the teaching herein in isometric view (9A) from the top, and isometric view from the back (9B).

FIGS. 10A to 10D schematically depict an embodiment of a device according to the teachings herein in isometric view (10A), top end view (10B), front view (10C) and side view (10D).

All of the devices depicted in FIGS. 3 to 10, comprise a plurality of individual combing teeth 16 distributed on a respective styling surface 14 in an irregular and non-linear fashion.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and scope of the appended claims.

Citation or identification of any reference in this application shall not be construed as an admission that such reference is available as prior art to the invention.

Section headings are used herein to ease understanding of the specification and should not be construed as necessarily limiting.

The invention claimed is:

1. A device suitable for use in the styling of hair, the device comprising:

a) a device body including a handle;

b) physically associated with said device body, a backing component bearing a styling surface having at least one peripheral edge;

c) a plurality of at least ten combing teeth distributed on said styling surface, each said combing tooth fixedly attached to said styling surface through a respective tooth base so as to protrude perpendicularly from said styling surface, each said combing tooth having:

i. along a height axis perpendicular to said styling surface, a height measured from said base of said tooth at said styling surface to a respective tooth tip, ii. along a length axis of said tooth on said styling surface, a length, iii. along a width axis on said styling surface and perpendicular to said length axis, a width, said width being less than said length, iv. a top cross section in a plane including said width axis and said length axis, v. a front cross section in a plane including said width axis and said height axis, and vi. a side cross section in a plane including said length axis and said height axis; wherein said length axes of said combing teeth of said plurality of teeth are parallel and define a combing direction of said styling surface; and d) a centering mechanism configured to apply a force to maintain said styling surface at a predetermined rest orientation relative to said device body, wherein said centering mechanism comprises a leaf spring, wherein the leaf spring extends into said handle, wherein the at least some of the plurality of combing teeth have a hollow side cross section, and wherein said styling surface is movably fixed to said device body, allowing rotation of said styling surface relative to said device body around a rotation axis perpendicular to said styling surface, while being devoid of an internal drive to actively affect the rotation of said styling surface.

2. The device of claim 1, wherein said plurality of at least ten combing teeth are distributed on said styling surface in an irregular fashion or a non-linear fashion.

3. The device of claim 1, wherein for each said specified combing tooth having said length axis, there are at least two different said combing teeth which respective length axes are parallel and within 2 mm of, but not colinear with, said length axis of said specified combing tooth.

4. The device of claim 1, wherein the distance between any two facing said combing teeth as measured between respective said bases along said styling surface in perpendicular to said combing direction is not more than 4.5 mm.

5. The device of claim 1, wherein the distance between any two facing said combing teeth as measured between respective said bases along said styling surface in perpendicular to said combing direction is not less than 0.3 mm and not more than 1.2 mm.

6. The device of claim 1, the device having a number of different populations of said combing teeth, all combing teeth of a given said population being identical and different from combing teeth of a different said population, wherein the number is at least two, and wherein each said population includes at least 4 said combing teeth.

7. The device of claim 1, the device configured so that the allowed said rotation of said styling surface is in an arc of not more than 180°.

8. The device of claim 1, the device configured to allow said rotation of said styling surface in an arc of not more than +/−30° from said predetermined rest orientation.

9. The device of claim 1, wherein said leaf spring generates at least some of said force to maintain said styling surface at said predetermined rest orientation relative to said device body, wherein said leaf spring is a component of the backing component, wherein said leaf spring is integrally formed with said backing component.

10. The device of claim 1, wherein said physical association allows said rotation of said backing component relative to said device body, allowing said styling surface to rotate relative to the arm and wrist of a user.

11. A device suitable for use in the styling of hair, comprising:

a) a device body of claim 1; and b) at least ten teeth suitable for combing hairs, and further comprising inorganic particles physically associated with an outer surface of said teeth, so that said combing teeth are thereby configured for polishing hair.

12. The device of claim 1, wherein at least one side of a side cross section of a combing tooth arches upwards from said base of said tooth to said tip of said tooth.

13. The device of claim 12, wherein as a result of such arching, the tangential angle of leading edge measured relative to styling surface changes along said height axis from close to 90 degree close to styling surface at the said tip of said combing tooth.

14. The device of claim 12, wherein said arching results in less tearing of hair and increased tangle-release of hair.

15. The device of claim 1, wherein both sides of a side cross section of a combing tooth arch upwards from said base of said combining tooth to said tip of said combing tooth, so that a length at said tooth base is the longest part of said side cross section.

16. The device of claim 1, further comprising a plurality of guide teeth attached to the device, the plurality of guide teeth protruding beyond the tips of the combing teeth, wherein the plurality of guide teeth are located along a peripheral edge of the styling surface.

* * * * *